US005520513A

United States Patent [19]

Kuroki et al.

[11] Patent Number: 5,520,513

[45] Date of Patent: May 28, 1996

[54] FAN APPARATUS

[75] Inventors: Shinya Kuroki, Obu; Shigeru Akaike, Chiryu, both of Japan

[73] Assignee: Nippondenso Co., Ltd., Kariya, Japan

[21] Appl. No.: 258,377

[22] Filed: Jun. 10, 1994

Related U.S. Application Data

[63] Continuation of Ser. No. 27,596, Apr. 30, 1993, abandoned, which is a continuation of Ser. No. 665,947, Mar. 7, 1991, abandoned.

[30] Foreign Application Priority Data

Mar. 7, 1990 [JP] Japan ..... 2-55841
Jan. 18, 1991 [JP] Japan ..... 3-004604

[51] Int. Cl.[6] ..... F04D 19/00

[52] U.S. Cl. ..... 415/223; 416/169 A

[58] Field of Search ..... 416/169 A; 415/208.1, 415/223

[56] References Cited

U.S. PATENT DOCUMENTS

| | | | |
|---|---|---|---|
| 3,028,072 | 4/1962 | Atalla | 416/169 A |
| 3,433,403 | 3/1969 | Gerlitz | 416/169 A |
| 3,903,960 | 9/1975 | Beck . | |
| 3,937,192 | 2/1976 | Longhouse | 416/169 A |
| 4,173,995 | 11/1979 | Beck | 416/169 A |
| 4,189,281 | 2/1980 | Katagiri et al. | 415/223 |
| 5,066,194 | 11/1991 | Amr et al. | 415/223 |

FOREIGN PATENT DOCUMENTS

| | | | |
|---|---|---|---|
| 2497883 | 7/1982 | France | 416/169 A |
| 1584765 | 2/1981 | United Kingdom | 416/169 A |
| 2088953 | 6/1982 | United Kingdom . | |

OTHER PUBLICATIONS

M. Aoki et al "Noise Reduction of Condenser Cooling Fans for Automotive Air Conditioners" Mitsubishi Juko Technical Disclosure vol. 24 No. 2 (1987–3) pp. 161–167.

*Primary Examiner*—John T. Kwon
*Attorney, Agent, or Firm*—Cushman, Darby & Cushman

[57] ABSTRACT

A fan shroud 4 is positioned upstream of a heat exchanger 5. An intake portion 9 of the fan shroud 4 has the shape that the axial length a thereof is smaller than a radial length b thereof, so that the intake portion expands quickly and the air flowing inwardly toward the fan blade is well guided by the intake portion.

6 Claims, 27 Drawing Sheets

FAN APPARATUS

This is a continuation of application Ser. No. 08/027,596, filed on Apr. 30, 1993, which was abandoned upon the filling hereof; which was a continuation of Ser. No. 07/665,947 filed Mar. 7, 1991, now abandoned.

FIELD OF THE INVENTION

The present invention relates to a fan apparatus which is suitable for a cooling fan of an automobile radiator and/or a condenser of an automobile air conditioner. The fan apparatus of the invention is positioned upstream of the radiator and/or the condenser.

BACKGROUND OF THE INVENTION

A fan apparatus positioned upstream of radiator has been used. FIGS. 15 and 16 show the conventional fan apparatus 100 including a fan blade 101 and a fan shroud 102. Comparing with the fan apparatus 200 positioned downstream of the radiator 5 (shown in FIG. 17), the fan apparatus 100 positioned upstream of the radiator causes more noise. FIG. 18 shows the test result comparing the fan apparatus 100 with the fan apparatus 200. The solid line Q of FIG. 18 indicates the fan apparatus 100 positioned upstream of the radiator, and the dot line R of FIG. 18 indicates the fan apparatus 200 positioned downstream of the radiator.

It is presumed that the air generated by the fan apparatus 100 cause more turbulent flow than that of the fan apparatus 200. In order to reduce the turbulent flow of the fan apparatus 100, a suction ring 112 has been proposed to be positioned in front of the fan blade 101, such as shown in FIGS. 19 and 20.

However, it is very hard to determine the best design of the shape of the front edge of the suction ring 112 and the position of the suction ring 112, because of the turbulent flow is unsteady in accordance with the flow caused by the fan blade 101. Furthermore, since the suction ring is positioned within the air flow as, the suction ring itself causes the resistance of the air flow. Accordingly, the suction ring 112 reduces to the blowing efficiency. Furthermore, the suction ring 112 itself makes a noise.

SUMMARY OF THE INVENTION

A main purpose of the present invention is to reduce the noise caused by the fan apparatus positioned upstream of the cooling object.

In order to attain the object of the present invention, the present inventors have tried to observe the flow caused by the fan blade 2. As shown in FIG. 21, a serious turbulent flow is generated at the edge portion 12 of the fan shroud 4, namely, quick turn flow is observed at the edge 12. The present inventors then examined how this turbulent flow is generated.

In order to investigate the turbulent flow, the present inventors had prepared the fan shroud 4 having no intake portion (shown in FIG. 22), and has observed the air flow caused by the fan apparatus 100 shown in FIG. 22. As shown in FIG. 22, a strong air flow flowing inwardly toward the boss portion of the fan blade 2 is observed at the outer edge 21 of the fan blade 2. Therefore, the present inventors have noted this flow and further examined the nature of this flow.

In order to examine the flow, the present inventors have prepared three models of the fan shroud 4 as shown in FIG. 23. The radius R1 of the model (1) is 80 mm, the radius R2 of the model (2) is 40 mm and the radius R3 of the model (3) is 20 mm.

FIG. 24 shows the relationship of the rotating speed of the fan blade and the noise level and air flow volume. The solid line A represents the test data of the model (1), the solid line B represents the test data of the model (2) and the solid line C represents the test data of the model (3). As shown from FIG. 24, the noise level and the air flow volume increase in accordance with the order of the model (1), (2) and (3). Therefore, the present inventors have concluded the open type fan shroud which opens upstream side of the fan blade 2 is preferred. Therefore, the present inventors then have prepared the model (5) and model (6). As shown from FIG. 4, the shape of the intake portion 9 of model (6) is much apart from the outer edge 21 of the fan blade 2 than that of the model (5).

FIG. 25 shows the relationship between the rotating speed of the fan blade 2 and the noise level and the air flow volume. The solid line D represents the test data of the model (5) and the solid line E represents the test data of the model (6). As shown from FIG. 25, the air flow volume of the model (5) and the model (6) are not so different each other, but the noise level of the model (6) is much decreased than that of the model (5), namely the model (6) can be decreased 4 Db. A at the rotation speed of 2000 rpm.

In order to examine the difference of the air flow in accordance with the shape of the intake portion of the fan shroud, the present inventors have observed the flow vector (FIG. 26) and the strength of the turbulent flow (FIG. 27). I in FIG. 27 indicates 0%–20% turbulent rate, II in FIG. 27 indicates 20%–40% turbulent rate, III in FIG. 27 indicates 40%–60% of turbulent rate, IV in FIG. 27 indicates 60%–80% of turbulent rate, and V in FIG. 27 indicates 80%–100% turbulent rate. The turbulent rate is calculated by the following formula.

$$\text{Turbulent rate}=100 \times ((U^2rms+V^2rms+W^2rms)/3(\overline{U}^2+\overline{V}^2+\overline{W}^2))1/2$$

U represents the air velocity of the air flow flowing inwardly toward the boss portion of the fan blade 2, V represents the velocity of the air flow flowing circumferential direction of the fan blade 2, W represents the velocity of the air flow of the axial direction of the boss portion 22, $\overline{U}$ represents an average verocity of the air flow of the radial direction of the fan blade 2, $\overline{V}$ represents an average velocity of the air flow of the circumferential direction of the fan blade, and $\overline{W}$ represents an average velocity of the air flow of the axial direction of the boss portion 22. When U=W=V=0, the turbulent rate is calculated 0. As clearly shown from FIGS. 26 and 27, the turbulent rate can be reduced by using the bellmouthed intake portion which opens the upstream end of the fan blade 2. The fan shroud 4 of the model (9) has been used for introducing air flow toward the cylindrical portion 10 smoothly, namely the intake portion 9 has been designed so that the sectional area of the intake portion 9 does not change quickly. However, since the fan apparatus 100 is positioned upstream of the radiator 5, the air pressure downstream of the fan blade should be increased. Therefore, the model (9) having an open space at the front edge 24 of the fan blade 2 is preferred for introducing the air to the rear edge 23 of the fan blade 2 and for diminishing the turbulent flow.

As shown from FIGS. 26 and 27, the overlapping area of the outer edge 21 of the fan blade 2 and the cylindrical portion 10 of the fan shroud influences the generation of the turbulent flow. Therefore, the present inventors then have examined the relationship between the overlapping area and the noise level. FIG. 28 shows the models which the present inventors have used during the examination. The radius r10, r11 and r12 of each model (10), (11) and (12) are 80 mm, 40 mm and 20 mm respectively. K in FIG. 28 represents the relational length between the rear edge 23 of the fan blade 2 and the connecting portion of the cylindrical portion 10 and the diffuser portion 11. The letter $k_1$ represents the length of the cylindrical portion 10 of the fan shroud. Therefore, the overlapping area is calculated as $K_1$–K. FIG. 29 shows the relationship between the overlapping area and the noise level and the air flow volume of the model (10). FIG. 30 shows the relationship between the overlapping area and the noise level and the air flow volume of the model (6) (shown in FIG. 4). The solid line in FIGS. 29 and 30 indicates the test data when only the automotive radiator is positioned downstream of the fan apparatus, and the solid line G of the FIGS. 29 and 30 represents the test data when the both the automotive radiator and the condenser for the automotive air conditioner are positioned downstream of the fan apparatus.

The fan apparatus of the present invention has been developed by using the test data described above. Namely, the fan apparatus of the present invention has been developed for introducing the air flow inwardly toward the radial direction of the fan blade.

In order to reduce the noise, the present inventors have designed the shape of the fan shroud in such a manner that the cylindrical portion of the fan shroud faces to the downstream side of the outer edge of the fan blade and that the radius length of the intake portion b is larger than the axial length a of the intake portion for introducing the air flow flowing inwardly. Since the radius length of b of the intake portion is designed large volume, the intake portion can well prevent the reverse flow at the edge of the intake portion, and since the intake portion is expanded quickly, the front side of the fan blade is opened. Accordingly, the fan apparatus of the present invention does not prevent the air flow flowing toward inwardly to the fan blade, so that it is well prevented to generate the turbulent flow.

DETAILED DESCRIPTION OF THE PREFERRED EMBODIMENT

Figure 1:
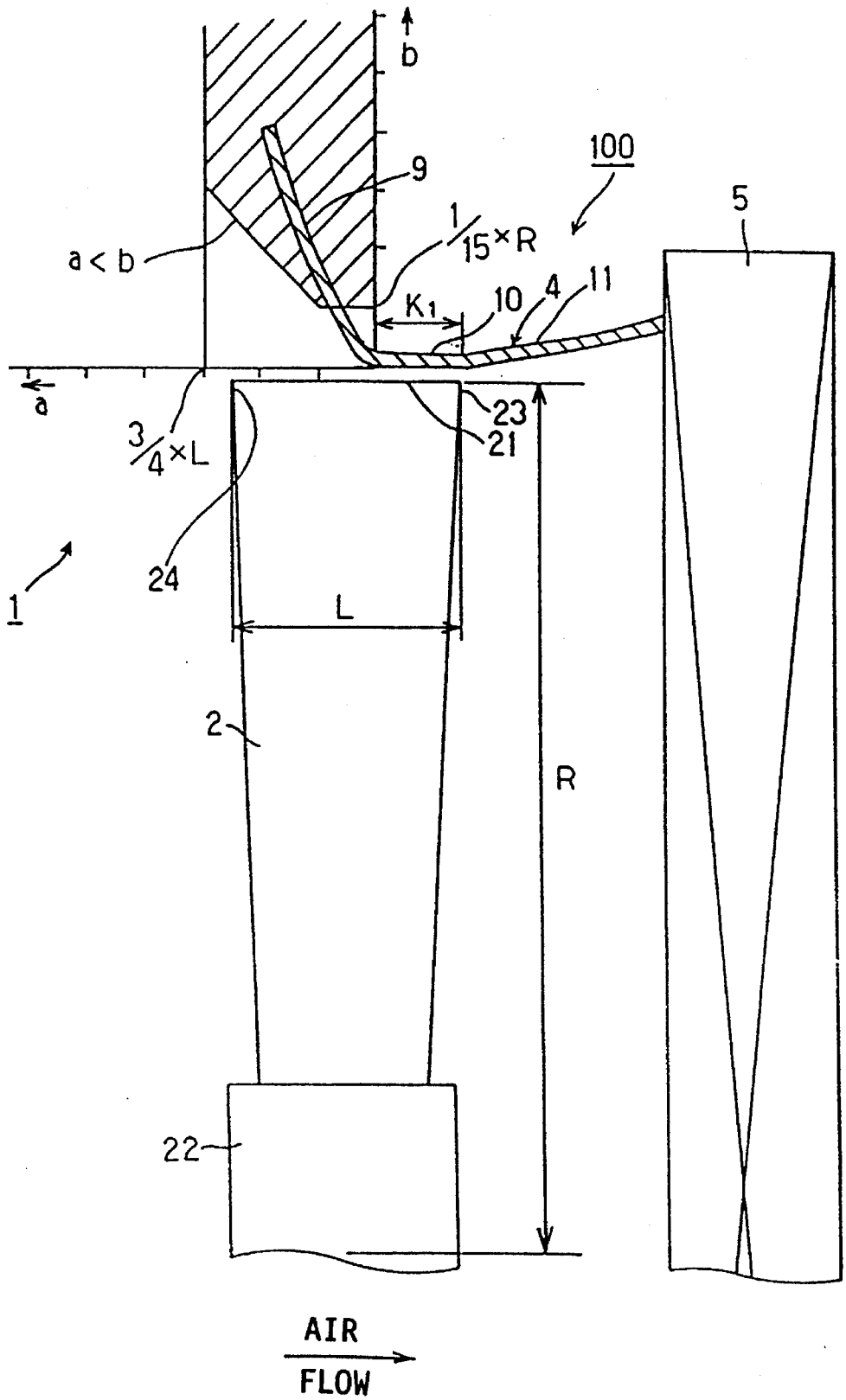
FIG. 1 is a schematic view showing a embodiment of the present invention.
Figure 2:
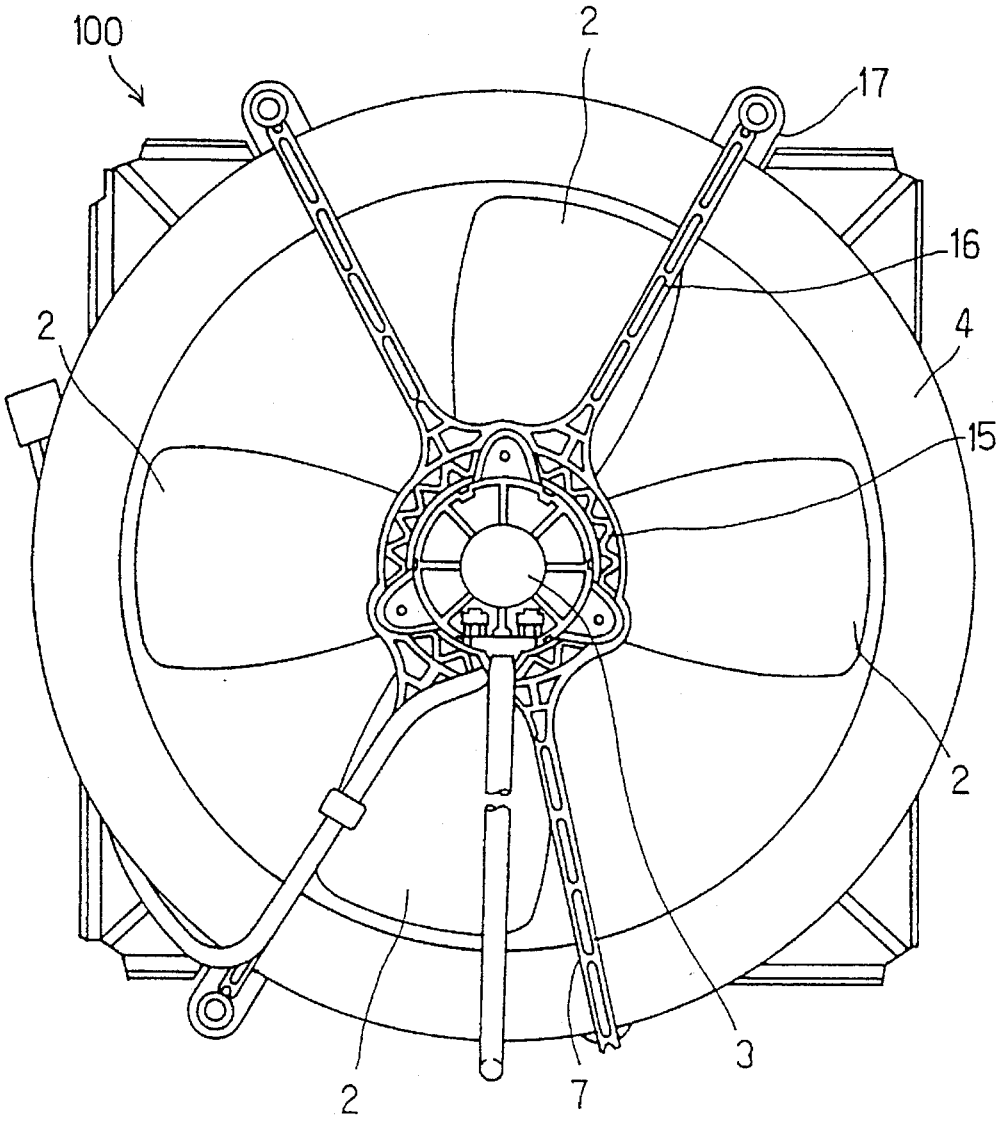
FIG. 2 is a front view of the embodiment of the present invention.
Figure 3:
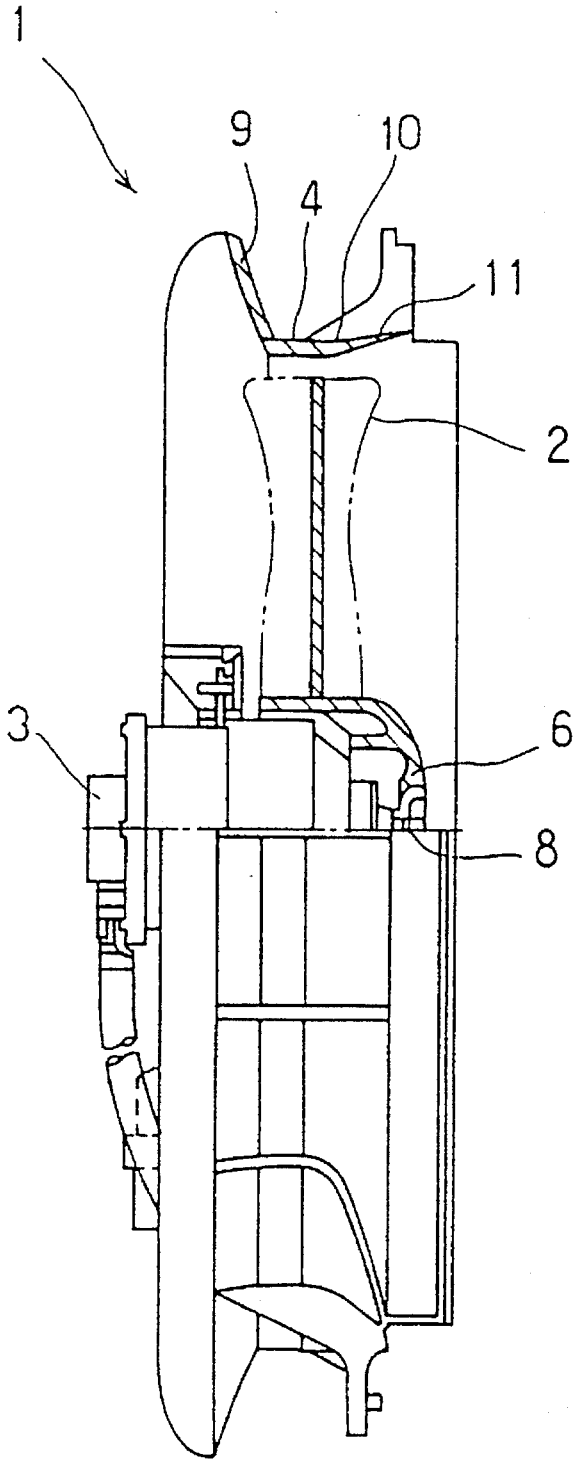
FIG. 3 is a partially sectional view of the fan apparatus showing in FIG. 2.

As shown from FIG. 1, the fan apparatus 100 of the present invention has a plurality of fan blades 2, which are extending radially. The boss portion 22 is positioned at the center of the fan blade. The center portion 6 of the boss portion 22 is connected to a motor 3 via a bolt B as shown in FIG. 2. The motor 3 is fixed to a flange 15 which is connected to the fan shroud 4 via stays 16. The fan shroud 4 has a cylindrical portion 10 at the center thereof, and an intake portion 9 formed front side of the cylindrical portion 10, and a diffuser portion 11 formed at a rear portion of the cylindrical portion 10. The fan shroud 4 is mounted on the radiator 5 via holding portions 17.

The cylindrical portion 10 faces to the outer edge 21 of the fan blade 2 through a certain tip clearance, so that the cylindrical portion 10 supports the generation of the air flow caused by the fan blade 2. The diffuser portion 11 leads the air flow caused by the fan blade 2 toward the radiator 5, so that the sectional area of the diffuser portion 11 is gradually increased.

Figure 4:
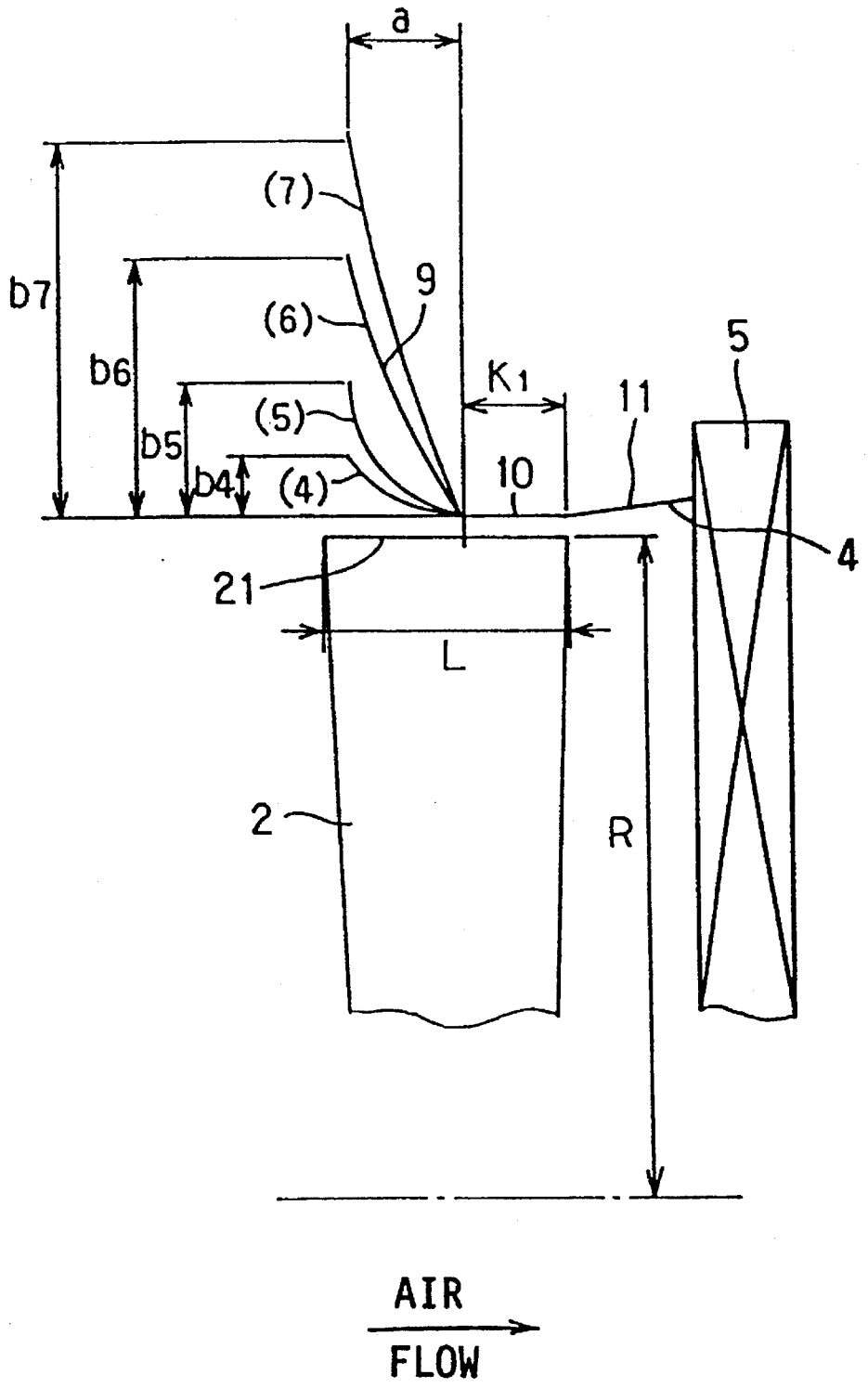
FIG. 4 is an illustrate models of the embodiment of the present invention.

The preferred shape and the dimension of the fan blade 2 and the fan shroud 4 is explained hereinafter. The effect of the axial length a and the radial length b of the intake portion 9 effecting the character of the fan apparatus is explained. FIG. 4 shows the four models each of which has the same axial length a of 20 mm and the different radial length b. The radial lengths of $b_4$, $b_5$, $b_6$ and $b_7$ are 10 mm, 20 mm, 40 mm and 60 mm respectively.

Figure 5:
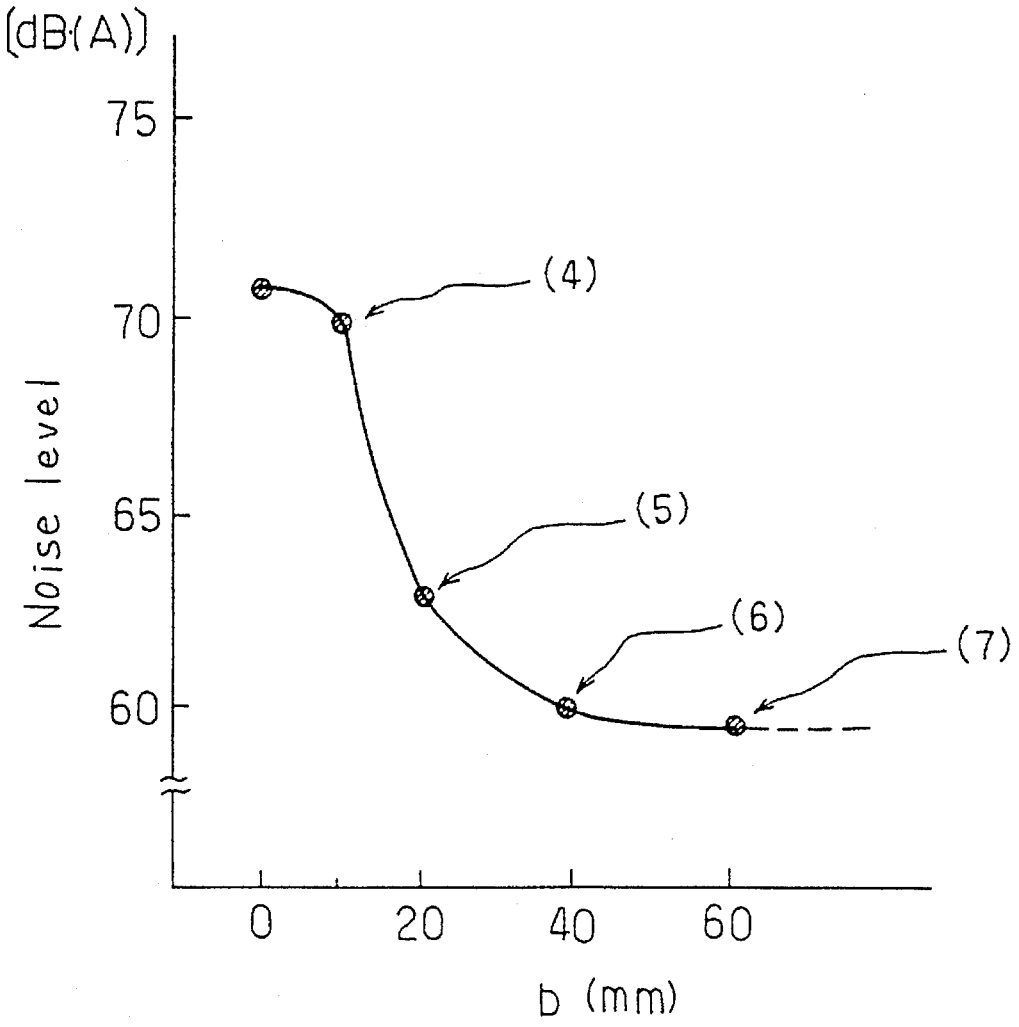
FIG. 5 shows the relationship between the radial length b and noise level.
Figure 9:
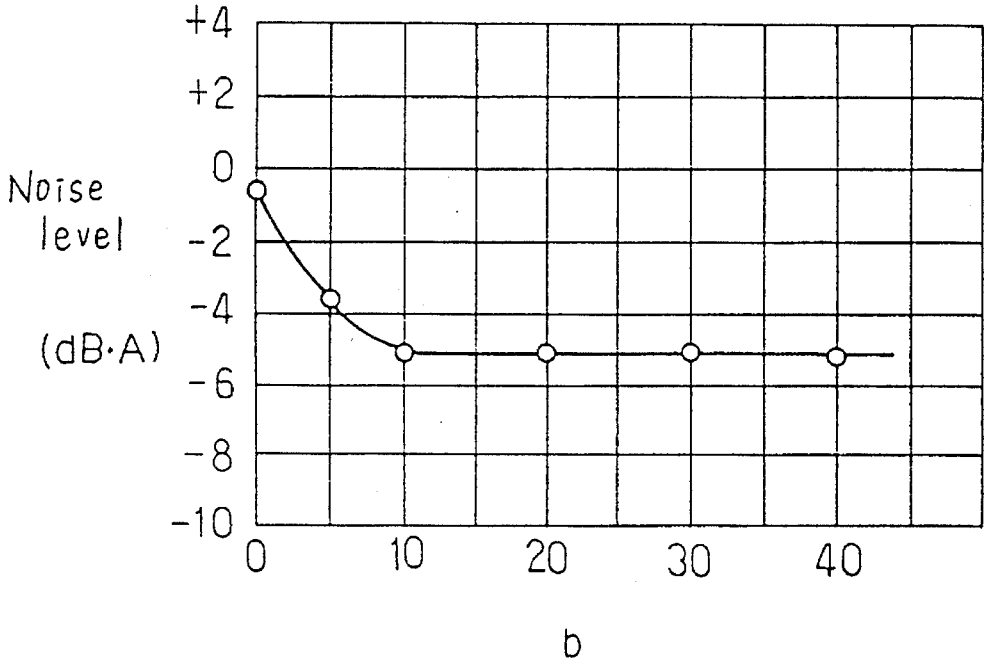
FIG. 9 shows the relationship between the axial length b and noise level while the inclining angle Θ is fixed.

FIG. 5 shows the noise level of each of the fan shroud. As shown from FIG. 5, the noise level can be reduced critically when the radial length b becomes larger than 20 mm which is the same length of the axial length a. Since the test data of FIG. 5 is obtained by the models shown in FIG. 4, and since the models shown in FIG. 4 have different shapes between each other, the present inventors then varies the radial length b while the inclining angle Θ of the intake portion 9 is maintained. FIG. 9 shows the test data showing the relationship between the radial length b and the noise level. The standard noise level shown in FIG. 9 is the noise level obtained by the fan shroud of the model (4) shown in FIG. 4. The radial length R of the fan blade 2 used by the test of FIG. 9 is 150 mm.

As shown from FIG. 9, the fan shroud having the radial length b greater than 10 mm is preferred when the radial length R of the fan blade 2 is 150 mm. Since, the radial length R of the fan blade 2 and the shape of the fan shroud 4 is presumed to have a similarity, the relationship between the radial length b of the intake portion 9 and the radial length R of the fan blade 2 can be maintained even though the radial length R of the fan blade 2 is varied. Accordingly, the radial length b of the intake portion 9 is required to be greater than one fifteenth of the radial length R of the fan blade 2.

Figure 6:
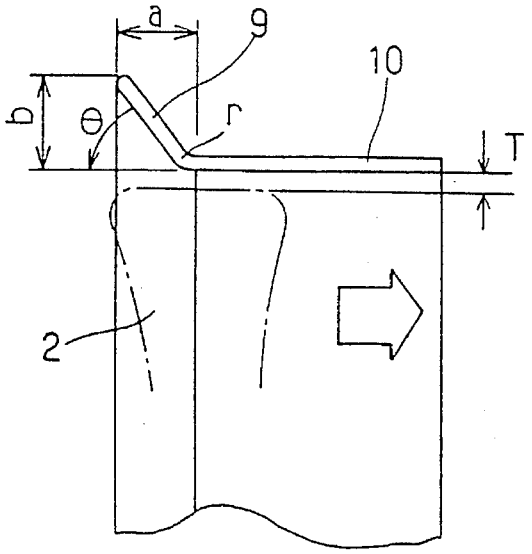
FIG. 6 is a schematic view of the fan shroud showing a axial length a, a radial length b and an inclining angle Θ.
Figure 7:
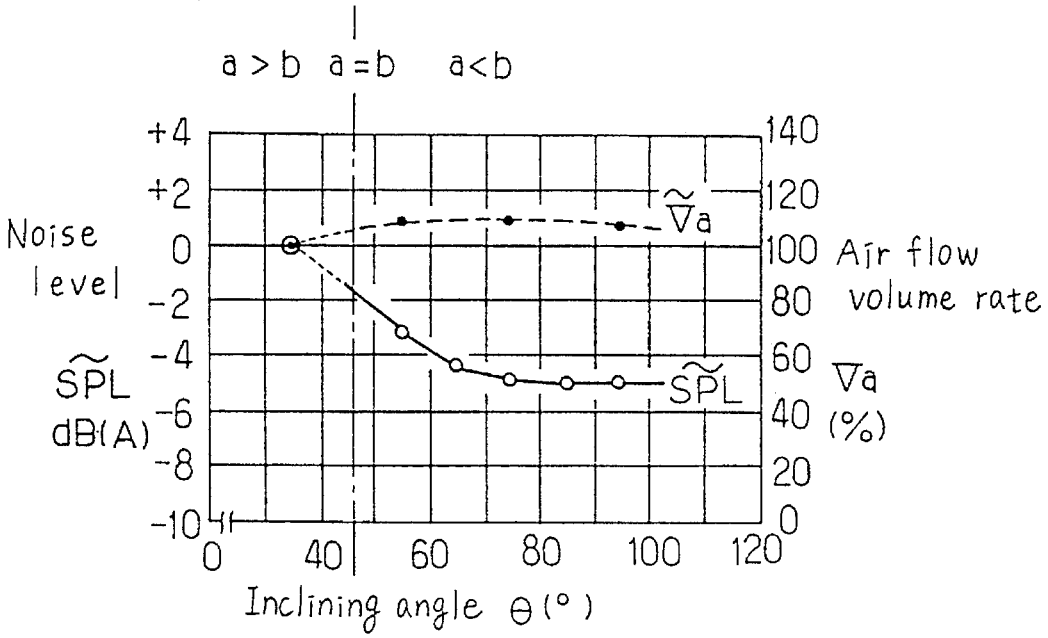
FIG. 7 shows the relationship between the inclining angle and noise level where the axial length a, the radial length b and the inclining angle Θ are varied.

The effect of the axial length a which is another parameter of the shape of the intake portion 9 is explained hereinafter. As described above, the axial length a and the radial length b work corporate, so that the present inventors have used the inclining angle Θ which is defined by both lengths of the axial length a and the radial length b, as shown in FIG. 6. FIG. 7 shows the relationship between the inclining angle Θ and the noise level and air flow volume rate. As shown from FIG. 7, the air flow volume does not change in accordance with the inclining angle Θ, on the other hand, the noise level can be reduced when the inclining angle Θ becomes larger than 60°, and the noise level of the inclining angle 45° is already much smaller than that of the fan shroud the axial length a of which is larger than the radial length b.

As shown from FIG. 7, the required minimum volume of the axial length a is not observed, because the intake portion 9 can work effectively even though the inclining angle Θ is higher than 90°. Namely, even though the axial length a becomes minus, still the intake portion 9 can work effectively. Therefore, the minimum length a is decided mainly because of the space in which fan shroud is positioned. In other words, the space of the engine room of the automobile is main factor for deciding the axial length a of the intake duct portion. The present inventors recommend that the radial length a is smaller than three fourths of the width L of the fan blade 2.

Figure 8:
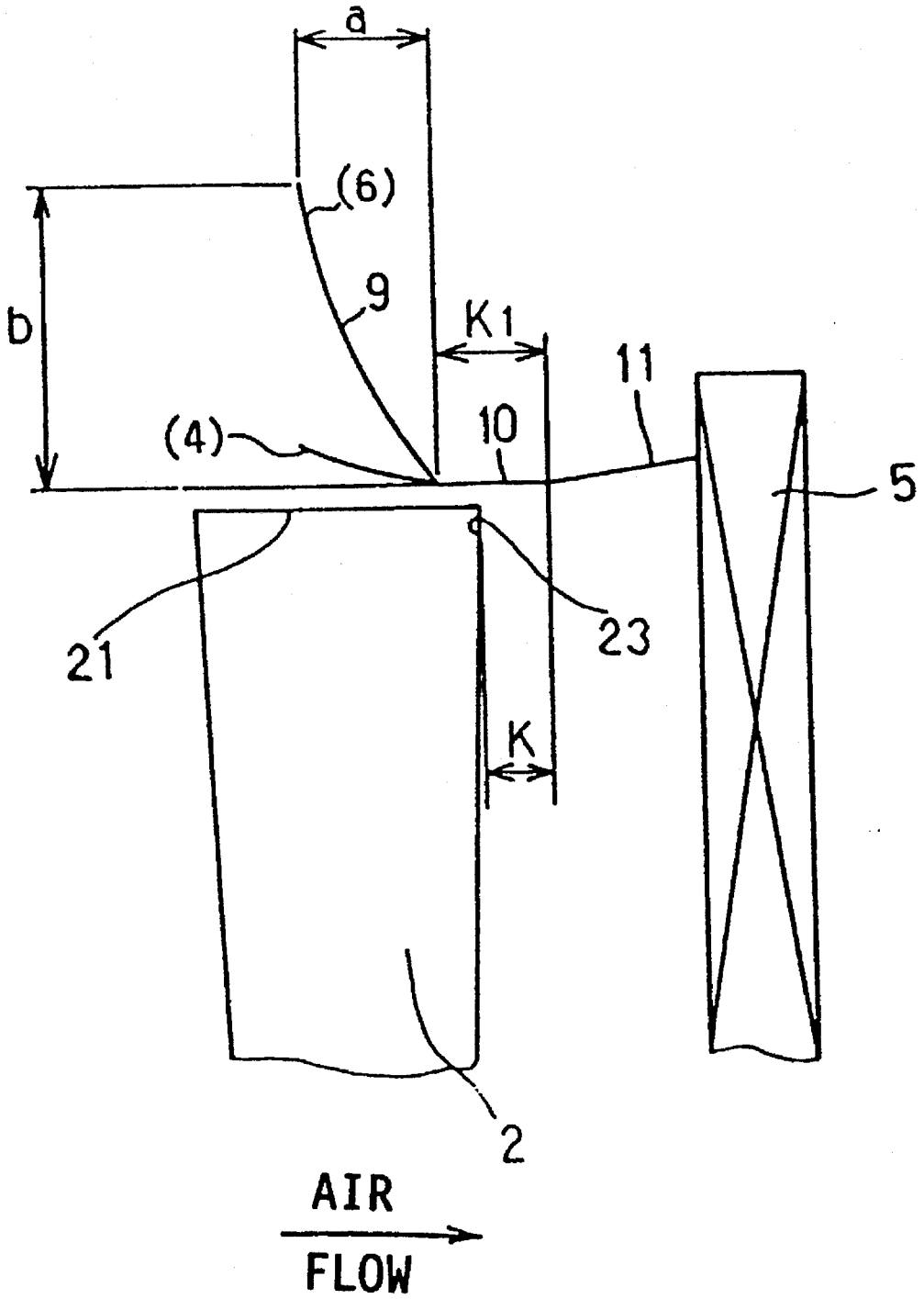
FIG. 8 is a schematic view of the fan apparatus of the present invention.
Figure 10:
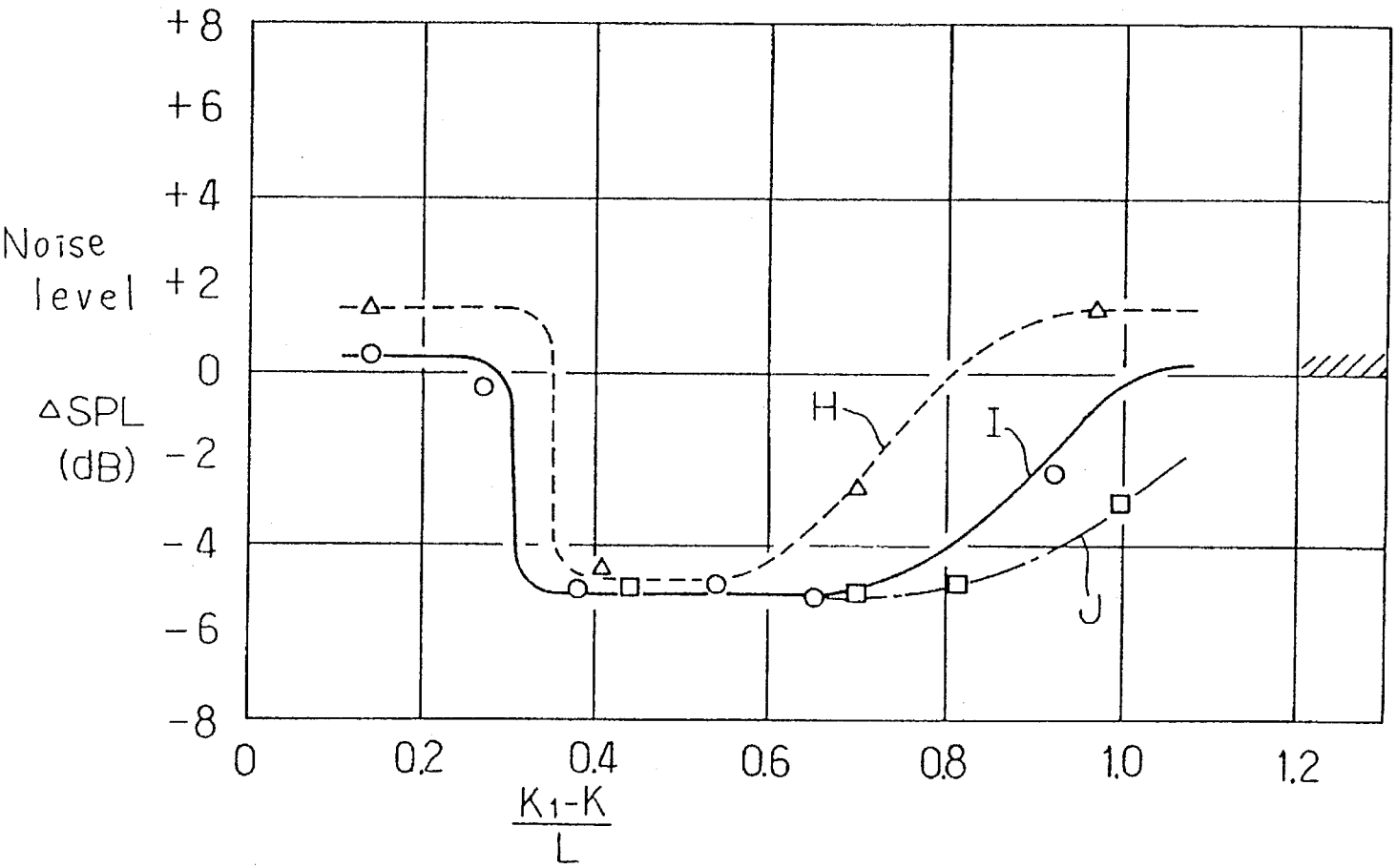
FIG. 10 shows the relationship between the overlapping rate and noise level.

As described above, the relative position between the fan blade 2 and the cylindrical portion 10 of the fan shroud 4 effects to the noise level. FIG. 8 shows the relative position between the fan shroud 4 and the fan blade 2. The model (4) of the fan shroud has the axial length a of 20 mm, the radial length b of 10 mm, and the model (6) has the axial length 2 a of 20 mm and the radial length b of 40 mm. FIG. 10 shows the relationship between the overlapping rate of $(K_1-K)/L$ and the noise level while the inclining angle Θ is kept 80°. The dot line H of FIG. 10 represents the test data of the fan shroud the radial length b of which is 0 mm, and the solid line I represents the test data of the fan shroud the radial length b of which is 10 mm and the dashed line J represents the test data of the fan shroud the radial length b of which is 20 mm. As shown from FIG. 10, the overlapping rate $(K_1-K)/L$ is preferred to be more than 0.4. A certain length of the overlapping area can prevent the circulating air flow namely the overlapping area prevent the reverse flow from the rear side of the fan blade 2 to the front side of the fan blade 2.

Figure 11:
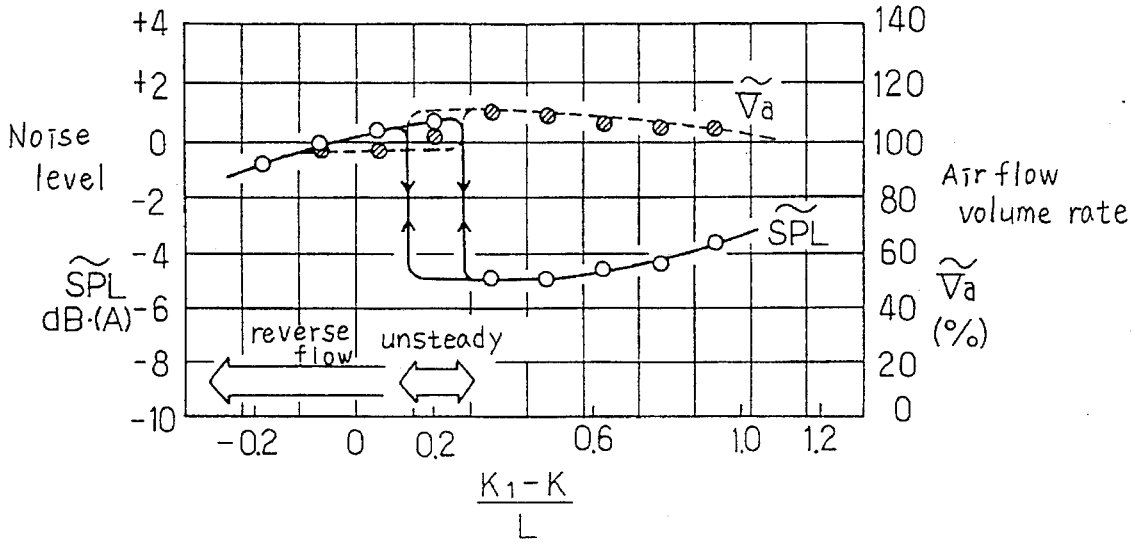
FIG. 11 shows the relationship between the overlapping rate and noise level.

FIG. 11 shows the relationship between the overlapping rate $(K_1-K)/L$ and the noise level and the air flow volume rate. As shown from FIGS. 10 and 11, the reverse flow may be generated when the overlapping rate $(K_1-K)/L$ is less than 0.3, and so that the noise level is increased and the flow volume is decreased when the overlapping rate is smaller than 0.3. When the overlapping rate becomes more than 0.6, the effect of the introducing portion 9 is decreased by the flow resistance of the cylindrical portion 10. Accordingly, the overlapping rate is preferred between 0.3 and 0.6.

Figure 28:
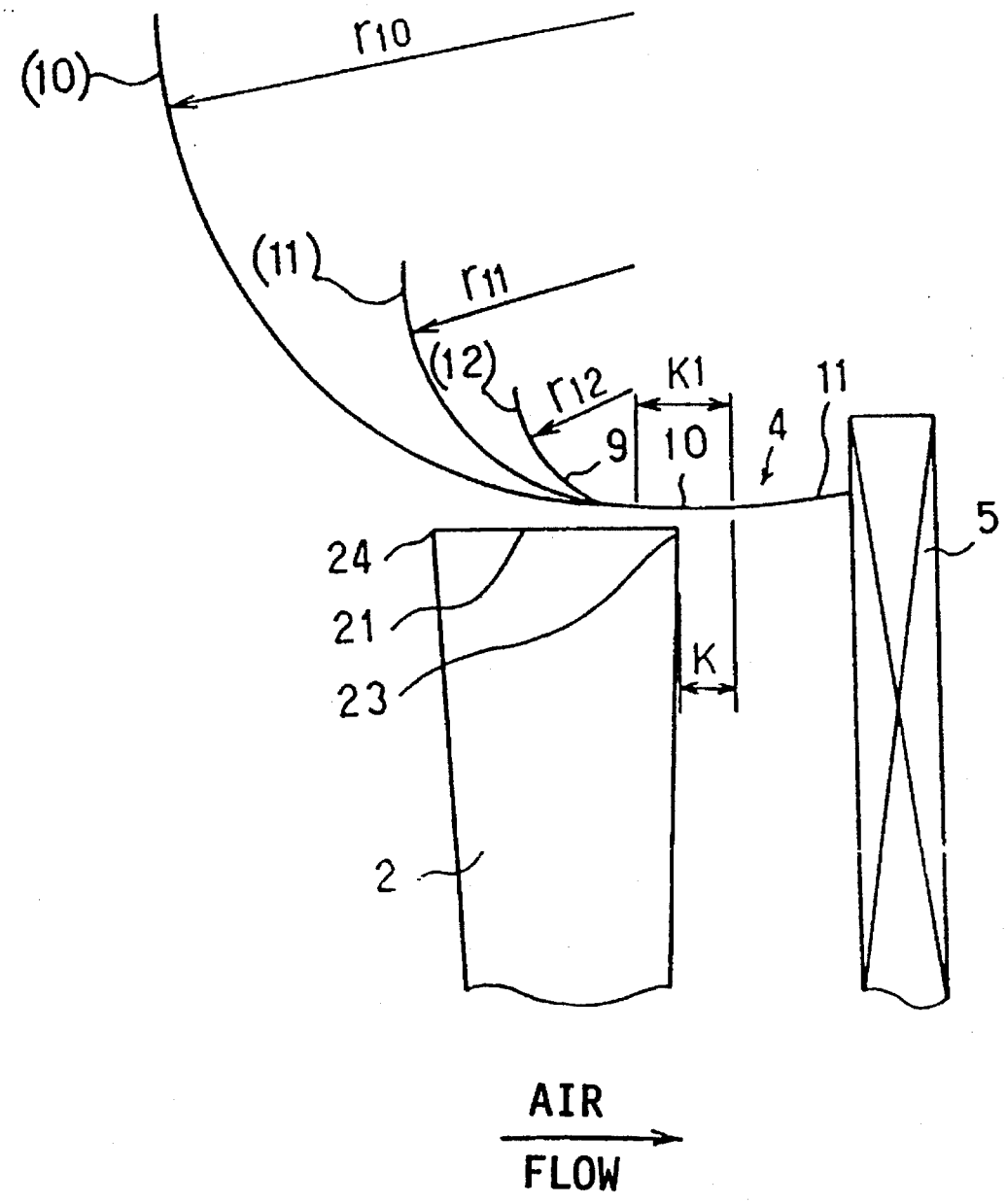
FIG. 28 shows the models of the fan shroud for explaining the present invention.
Figure 29:
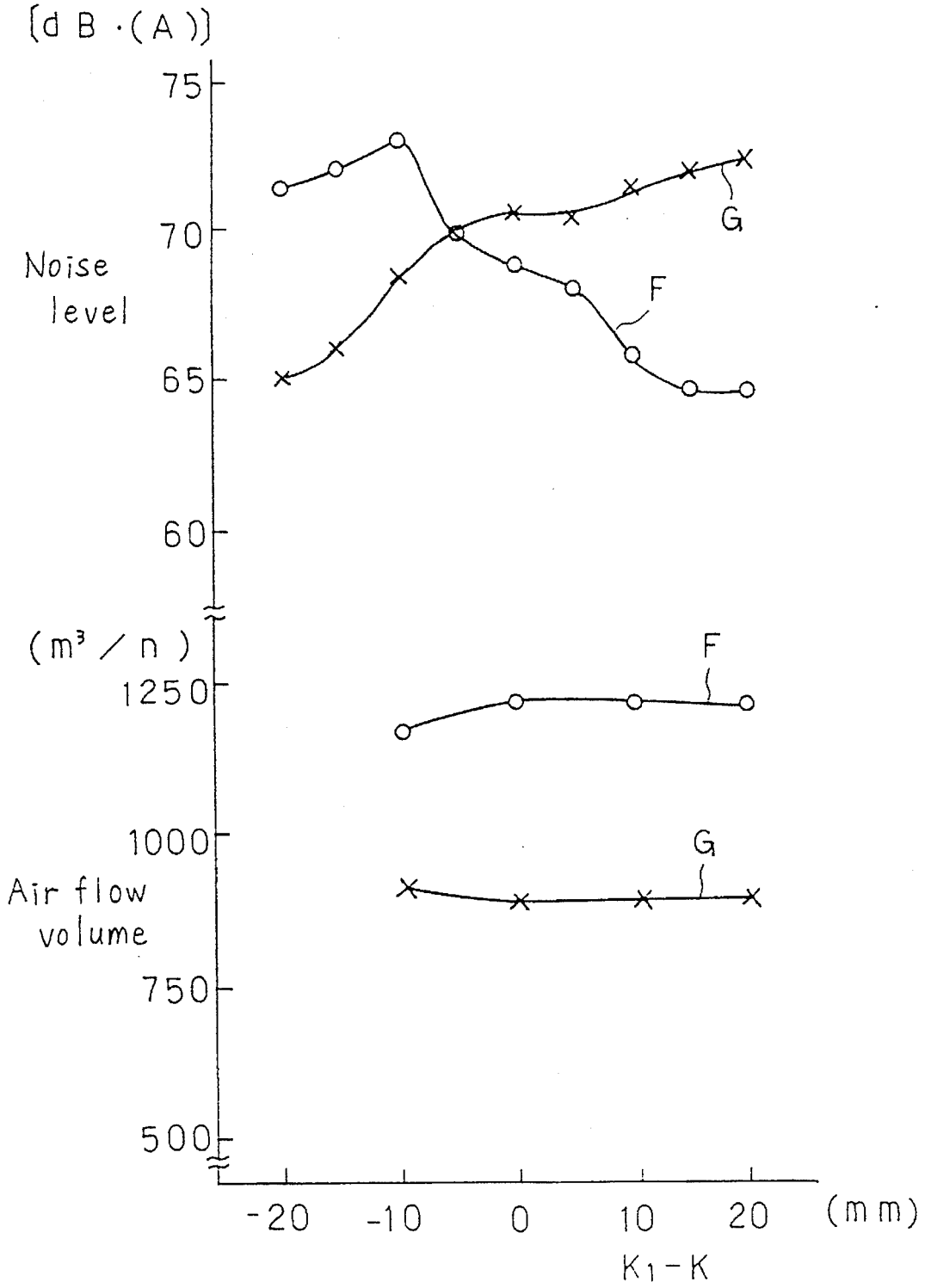
FIG. 29 shows the relationship between the relative length K and noise level and air flow volume.
Figure 30:
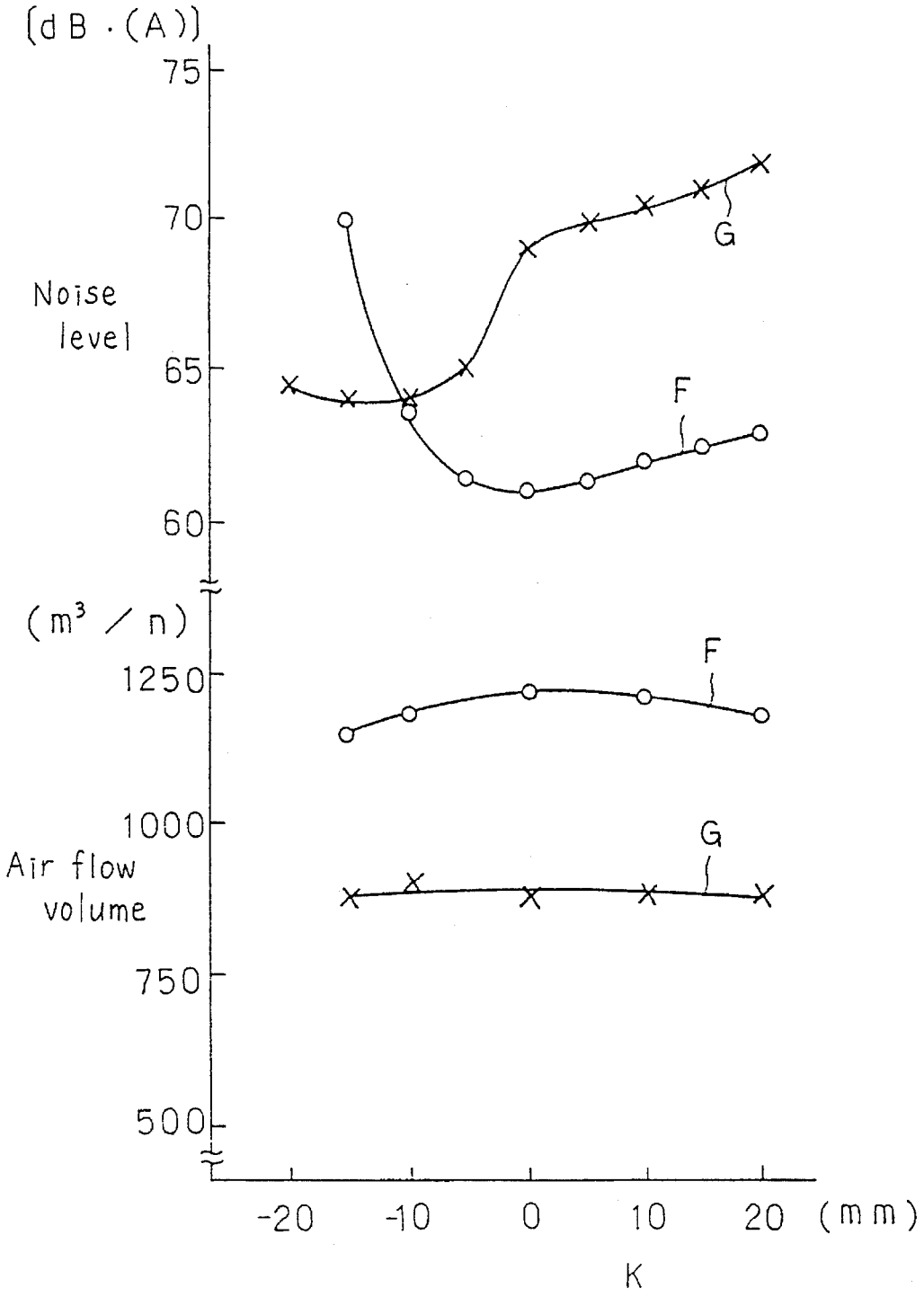
FIG. 30 shows the relationship between the relative length K and noise level and air flow volume.

As shown from the test result of FIGS. 29 and 30, the flow volume does not change very much because of the shape of the fan shroud and the overlapping area K. On the other hand, the noise level is varied in accordance with the shape of the fan shroud and the overlapping area K. Accordingly the shape of the fan shroud 2, especially the shape of the introducing portion 9 should be designed under the specific theory. As to the model (10) of FIG. 28, the preferred points are changed as much as 40 mm between the high resistance condition that both the radiator and the condenser are positioned downstream of the fan blade and the low resistance condition that the only radiator is positioned downstream of the fan blade. Furthermore, the noise level of the model (10) is higher than that of model (6). On the other hand, the difference of the preferred points of the model (6) between the high resistance condition and the low resistance condition is 10 mm. Accordingly, the model (6) can reduce the noise level even under the both the high resistance condition and the low resistance condition when the length K is designed −7.5 mm. The preferred volume of the relative length K is between −7.5 mm and −20.0 mm when the fan apparatus is used under the high resistance condition, and between −5.0 mm and 5.0 mm when the fan apparatus is used under the low resistance condition. The length K is also limited by the space where the fan shroud is positioned, so that the length K is preferred between −5.0 mm and −10.0 mm.

Though the fan blade of the embodiment described above has the width L of 40 mm and the radial length R of 150 mm, the fan blade 2 having other dimension can also be used for this invention. Any other fan apparatus having the fan shroud the dimension of which is $a<b$, $(1/15)\times R<b$ can be used.

Figure 12:
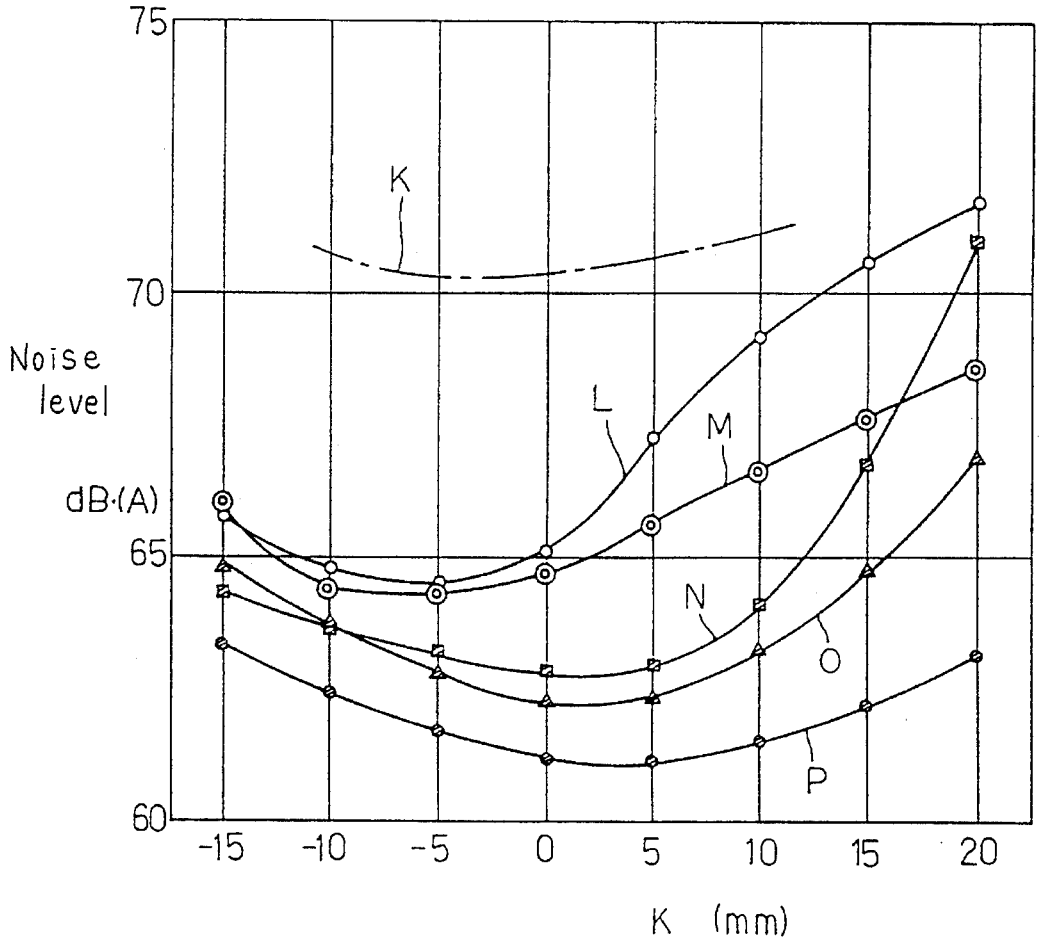
FIG. 12 shows the change of the noise level while a tip clearance t, a radial length r and a relative length K are varied.

The second embodiment of the present invention is then explained by using the drawings 12, 13 and 14. The fan shroud and the fan blade of the second embodiment is designed not only by using the axial length a and radial length b of the intake portion 9 but also by using the tip clearance t and the radial length r of the connecting portion between the intake portion 9 and cylindrical portion 10 (FIG. 6). By the way the tip clearance T of the first embodiment is designed 3.0 mm. FIG. 12 shows the test data when the tip clearance T and the radial length r are varies while the axial length a and the radial length b of the intake portion are fixed. The coordinate of FIG. 12 is the relative length K and the ordinate is the noise level. The noise level is inspected when the both radiator and the condenser is positioned downstream of the fan blade 2. The dash line K represents the model (4), the solid line L represents the fan apparatus having the tip clearance t of 3.0 mm and the radius curvature r of 10 mm, the solid line M represents the fan apparatus having the tip clearance t of 3.0 mm and the radius curvature r of 2.0 mm, the solid line N represents the test data of the fan apparatus having the tip clearance t of 6.0 mm and the radius curvature r of 6.0 mm, the solid line O represents the test data of the fan apparatus having the tip clearance t of 1.5 mm and the radius curvature r of 6.0 mm, and the solid line P represents the test data of the fan apparatus having the tip clearance t of 3.0 mm and the radius curvature r of 6.0 mm.

Figure 13:
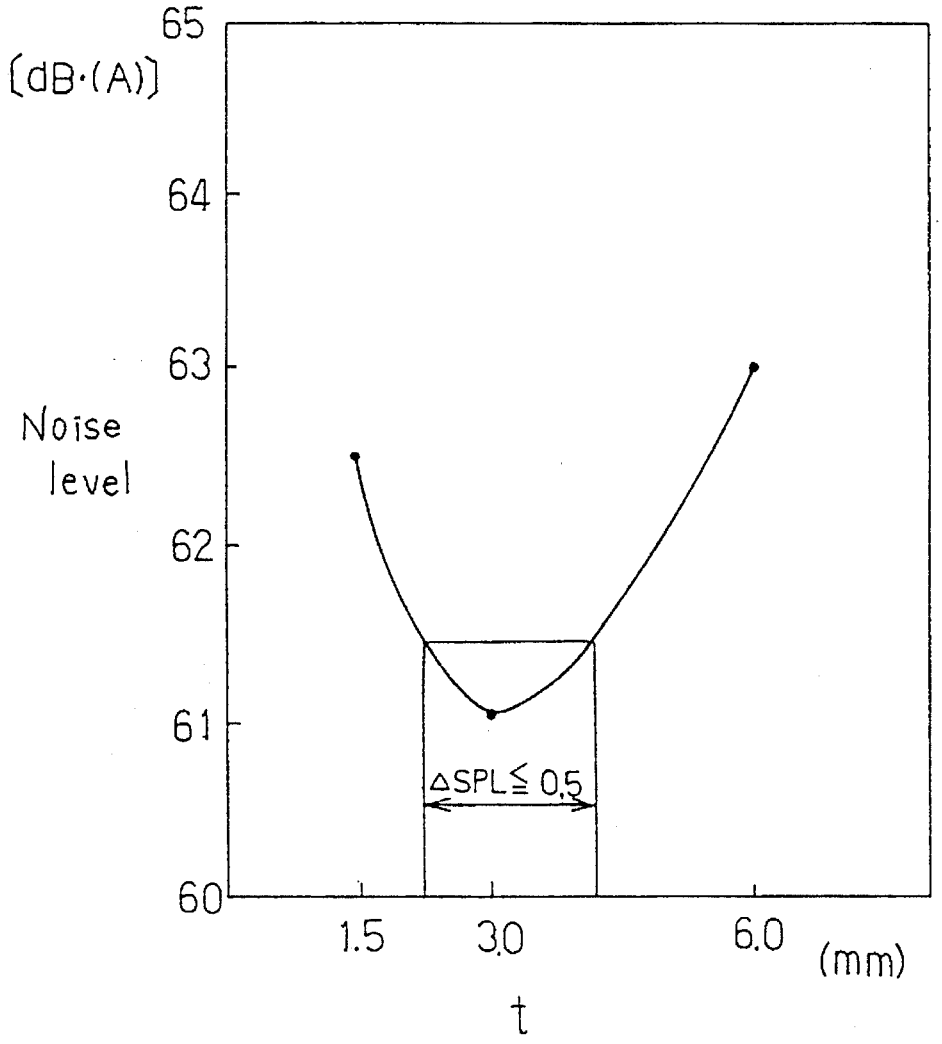
FIG. 13 shows the relationship between the tip clearance t and noise level.
Figure 14:
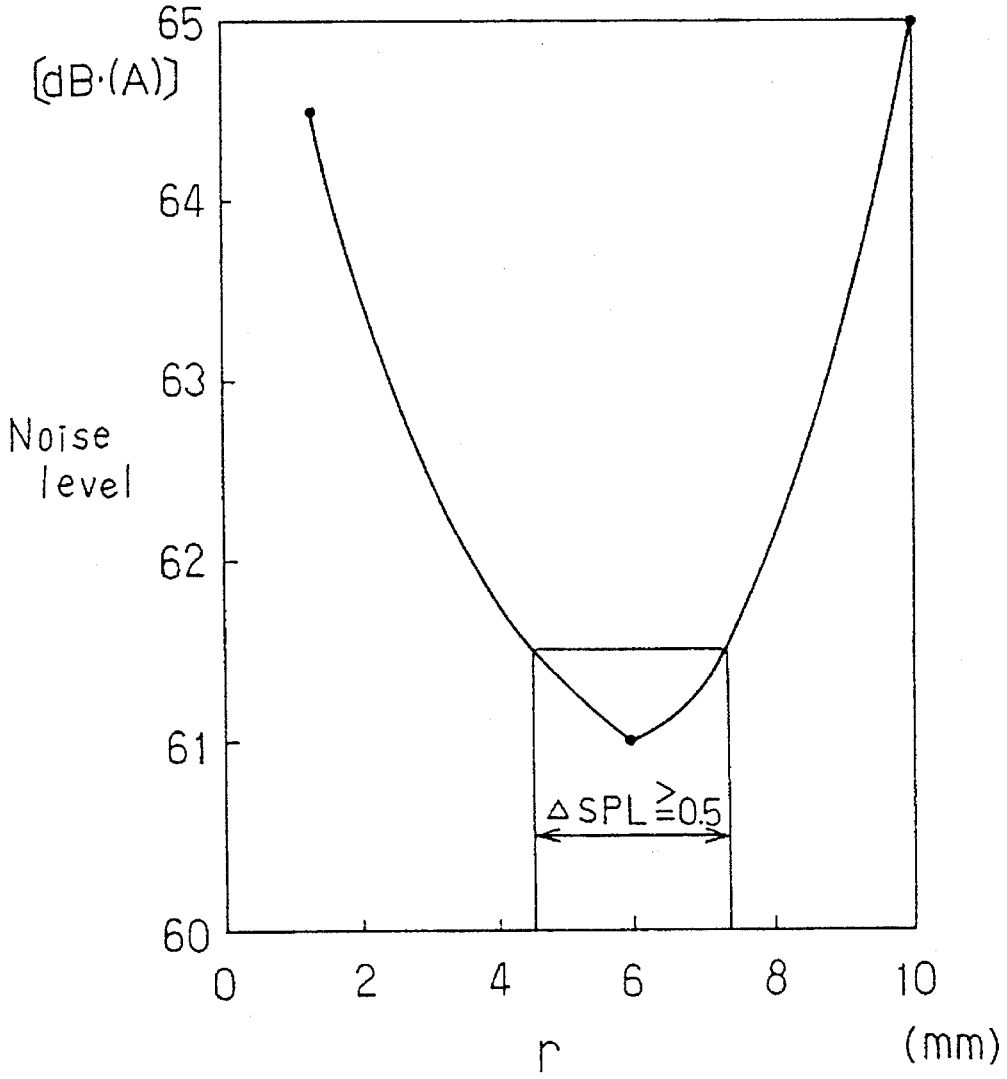
FIG. 14 shows the relationship between the radial length r and noise level.
Figure 15:
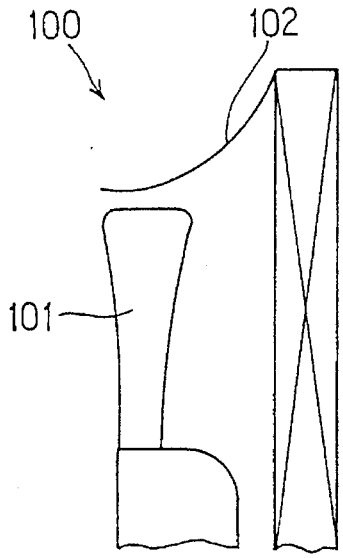
FIG.15 Prior art
FIG. 15 shows a fan apparatus of the prior art.
Figure 16:
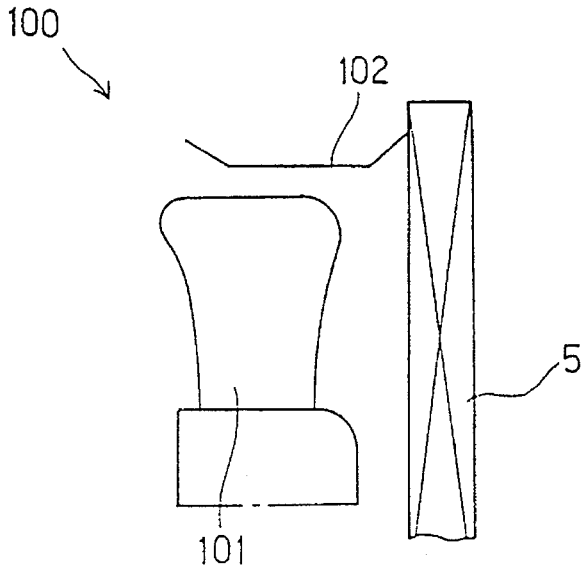
FIG.16 Prior art
FIG. 16 shows another fan apparatus of the prior art.
Figure 17:
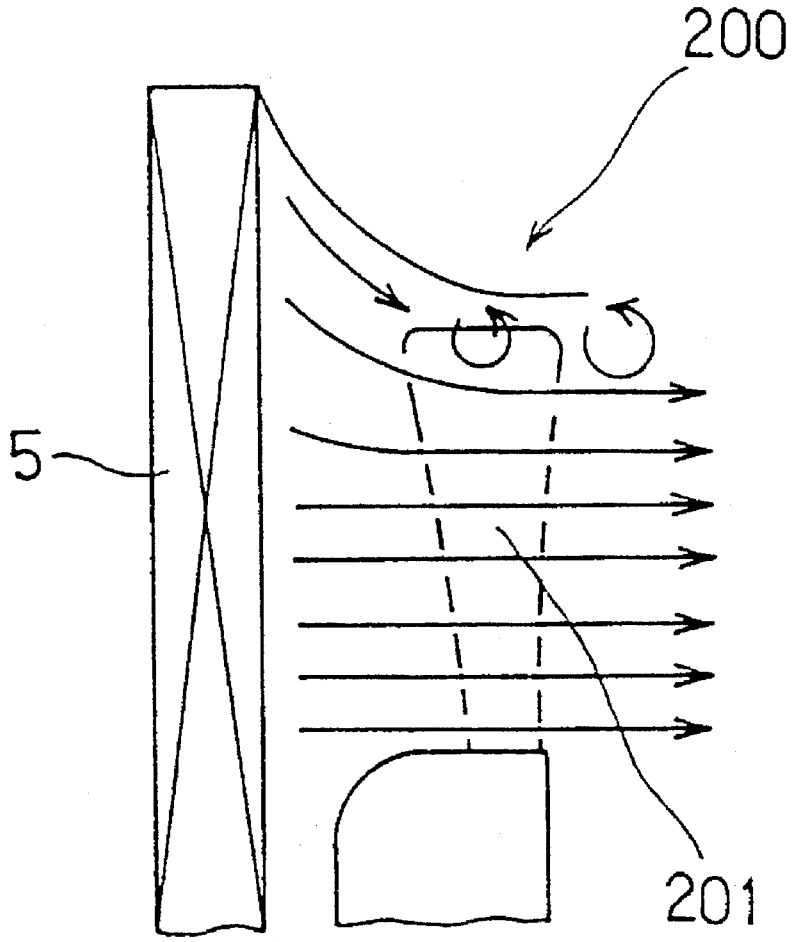
FIG.17 Prior art
FIG. 17 shows the other fan apparatus of the prior art.
Figure 18:
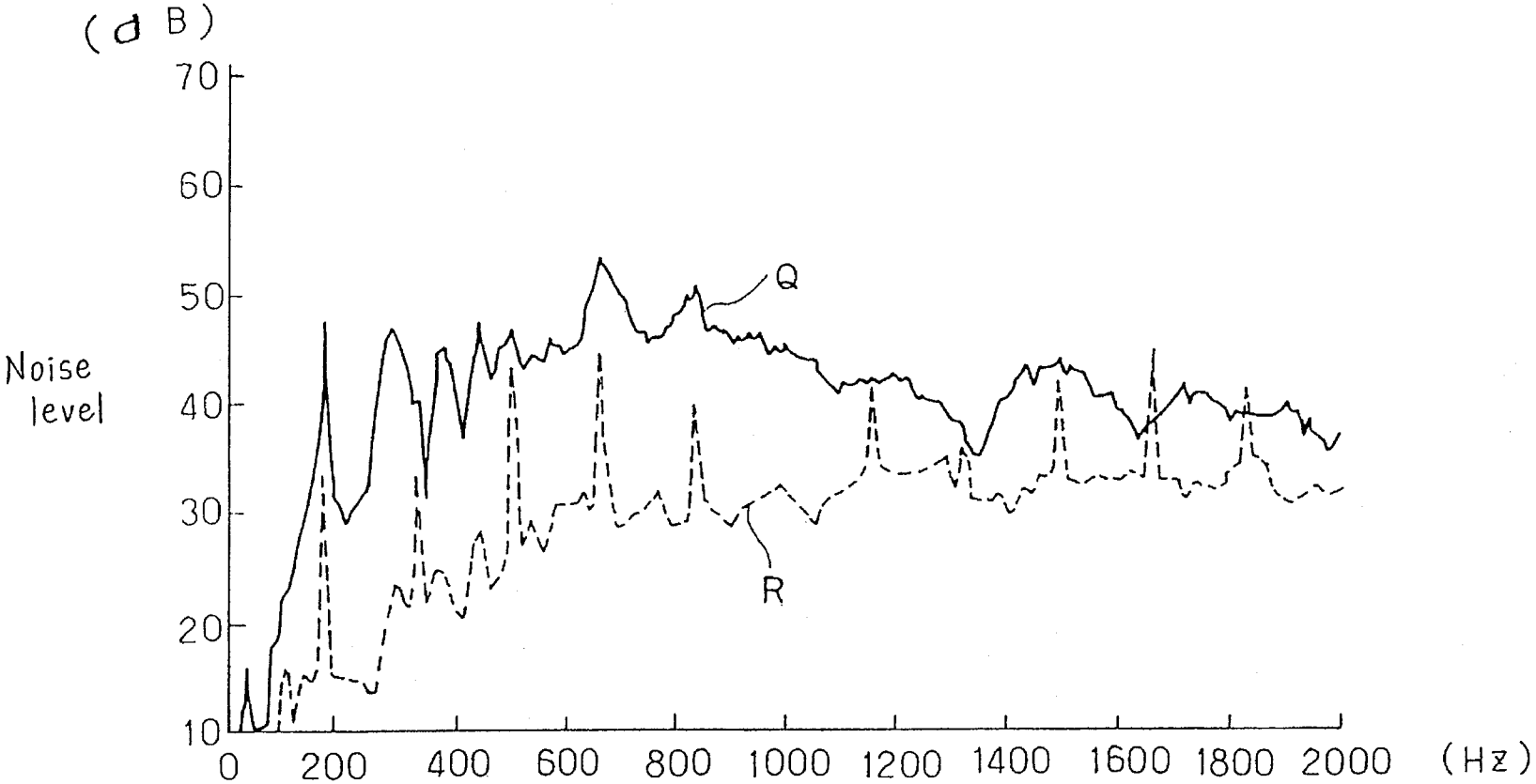
FIG. 18 shows the noise level of the fan apparatuses positioned upstream and downstream of a heat exchanger.
Figure 19:
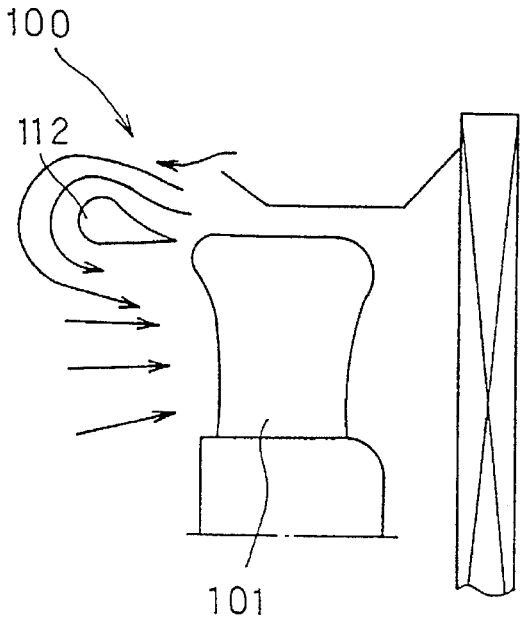
FIG. 19 Prior art
FIG. 19 shows the other fan apparatus of the prior art.
Figure 20:
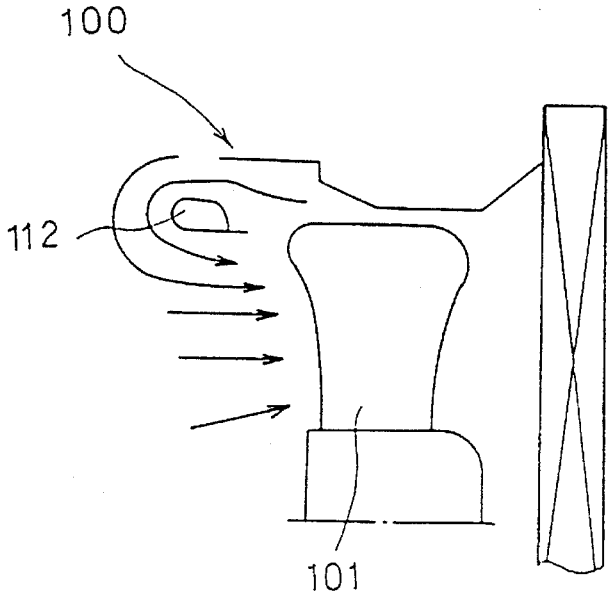
FIG. 20 Prior art
FIG. 20 shows the other fan apparatus of the prior art.
Figure 21:
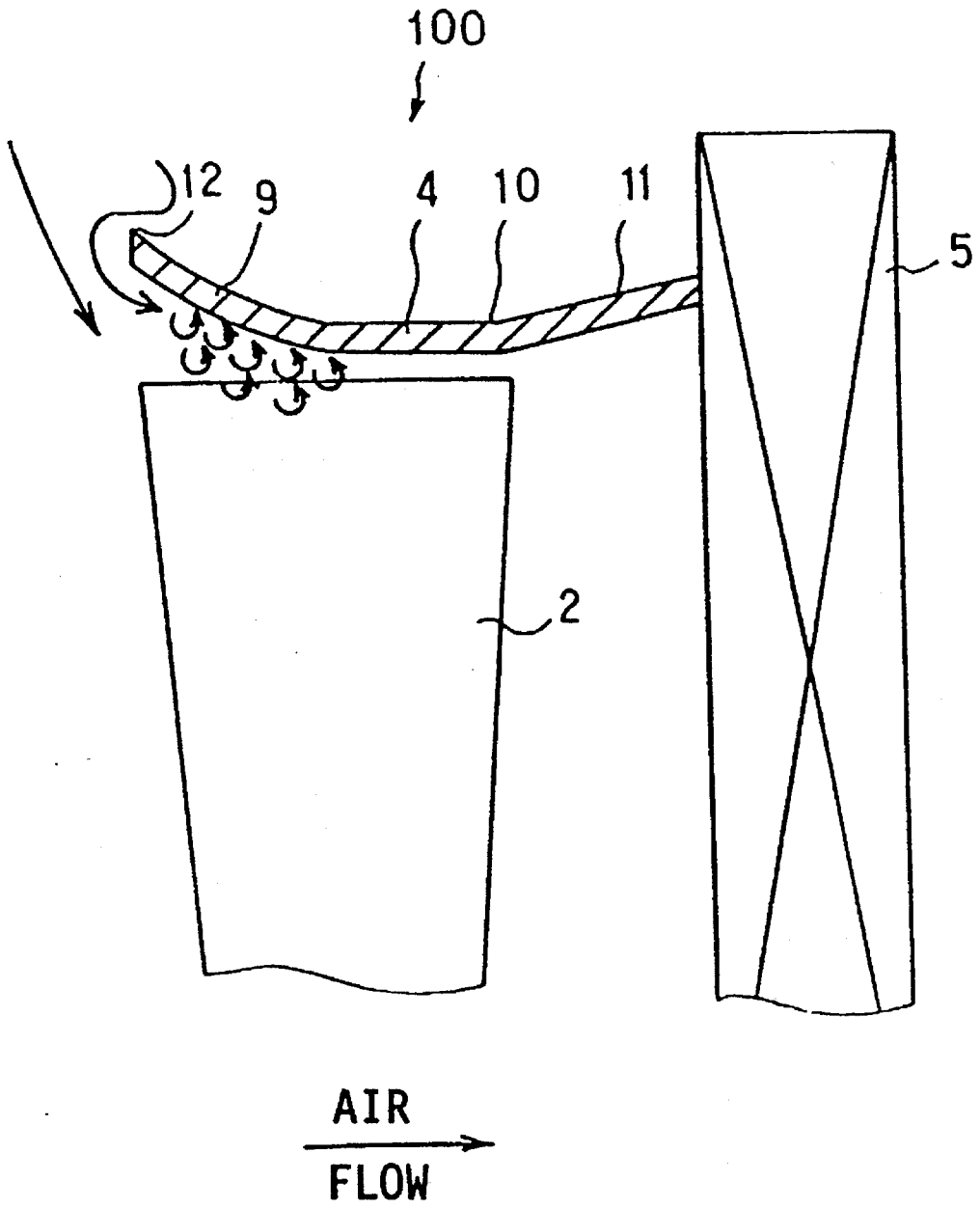
FIG. 21 PRIOR ART
FIG. 21 illustrates the air flow of the fan apparatus of the prior art.
Figure 22:
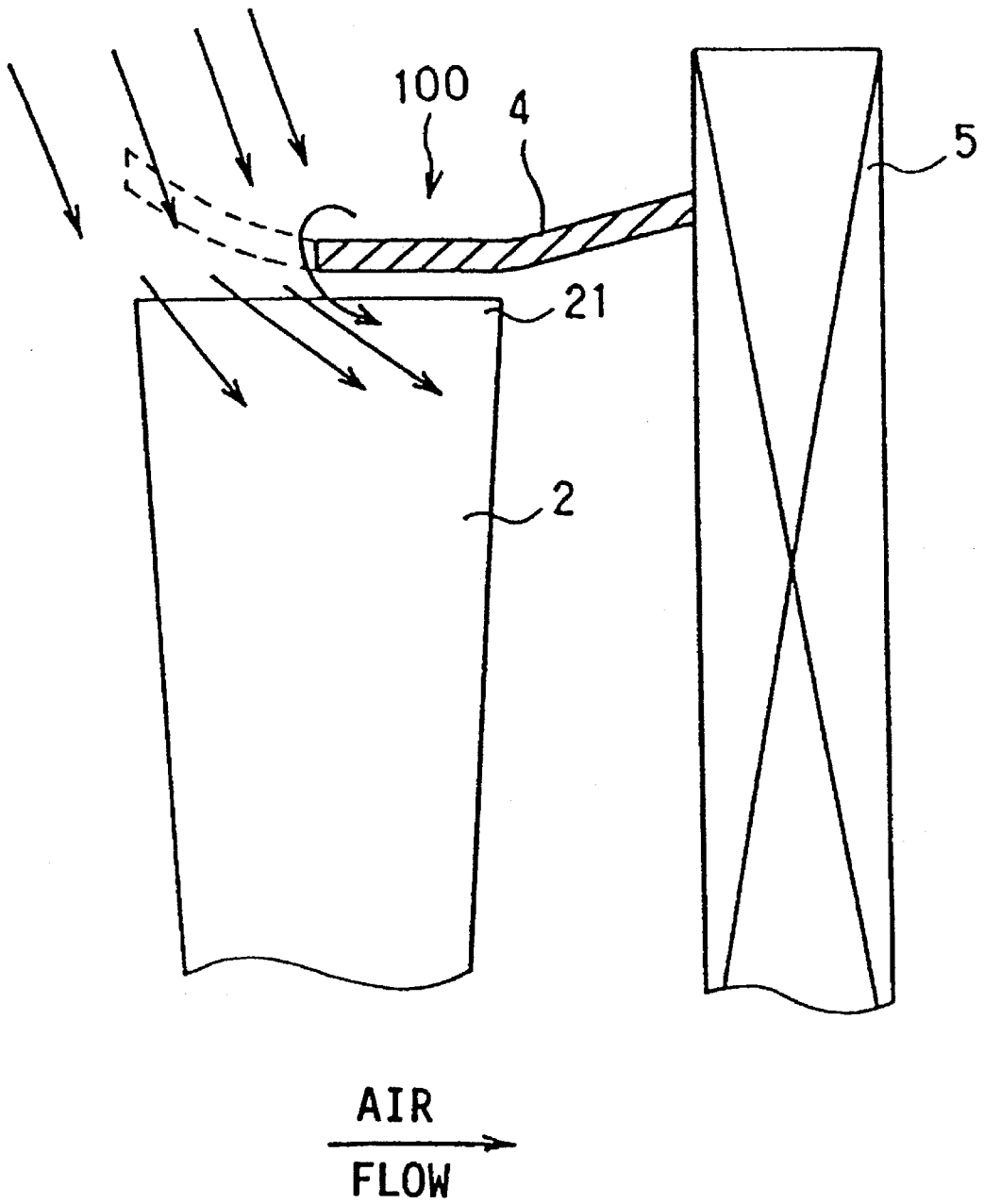
FIG. 22 shows the air flow of the fan apparatus where no intake portion is made.
Figure 23:
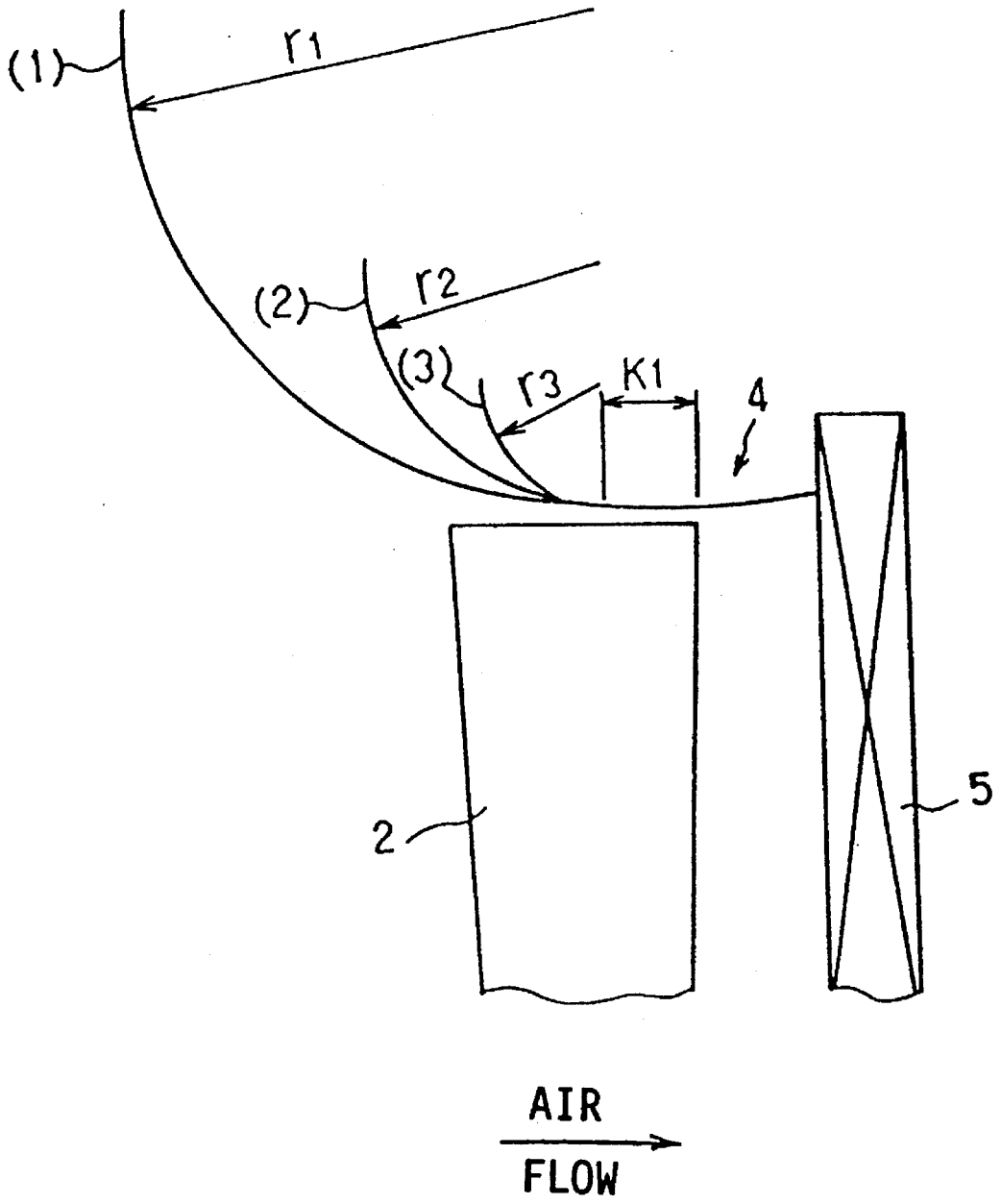
FIG. 23 shows models of the fan shroud for explaining the present invention.
Figure 24:
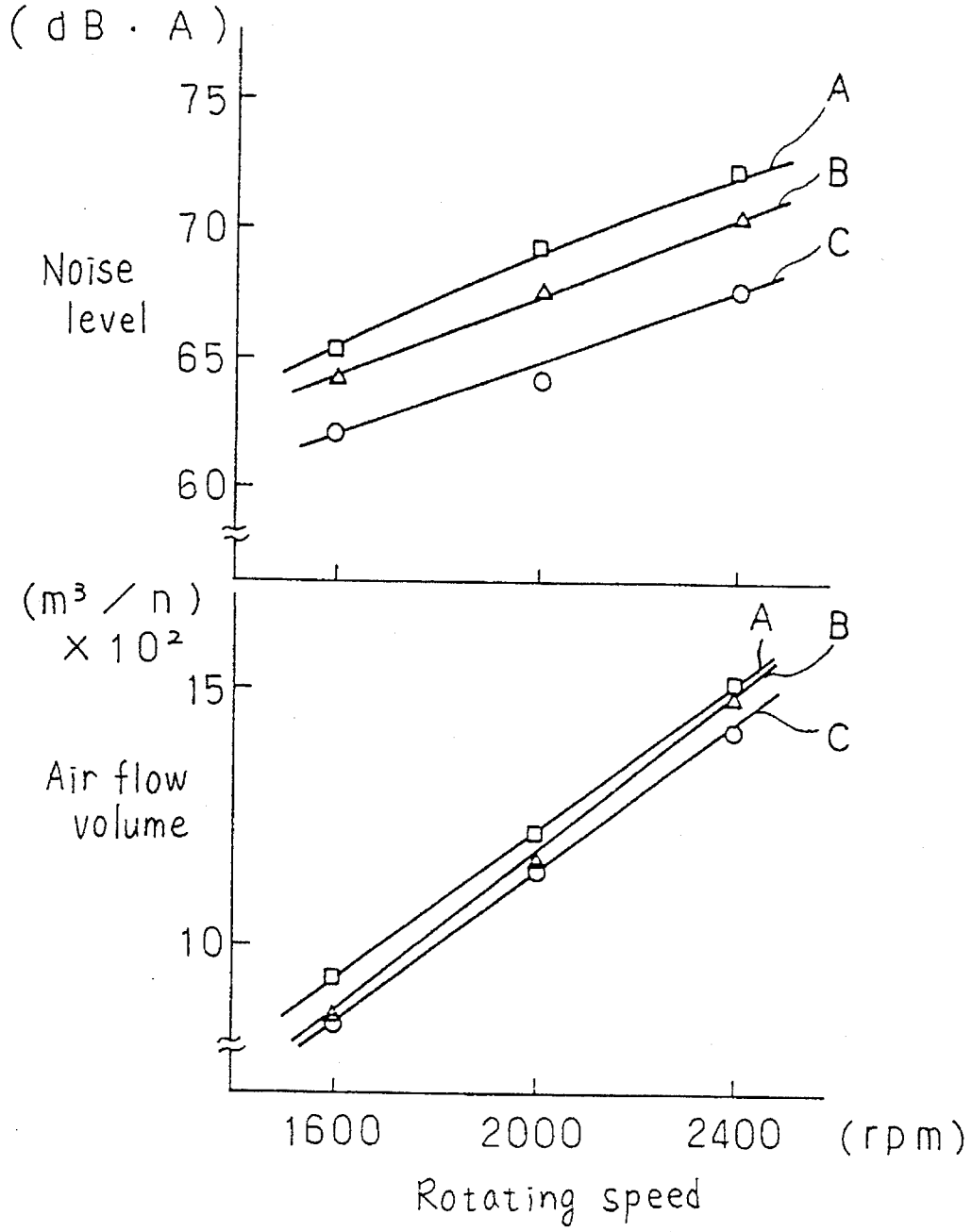
FIG. 24 shows the relationship between the rotating speed and noise level and air flow volume.
Figure 25:
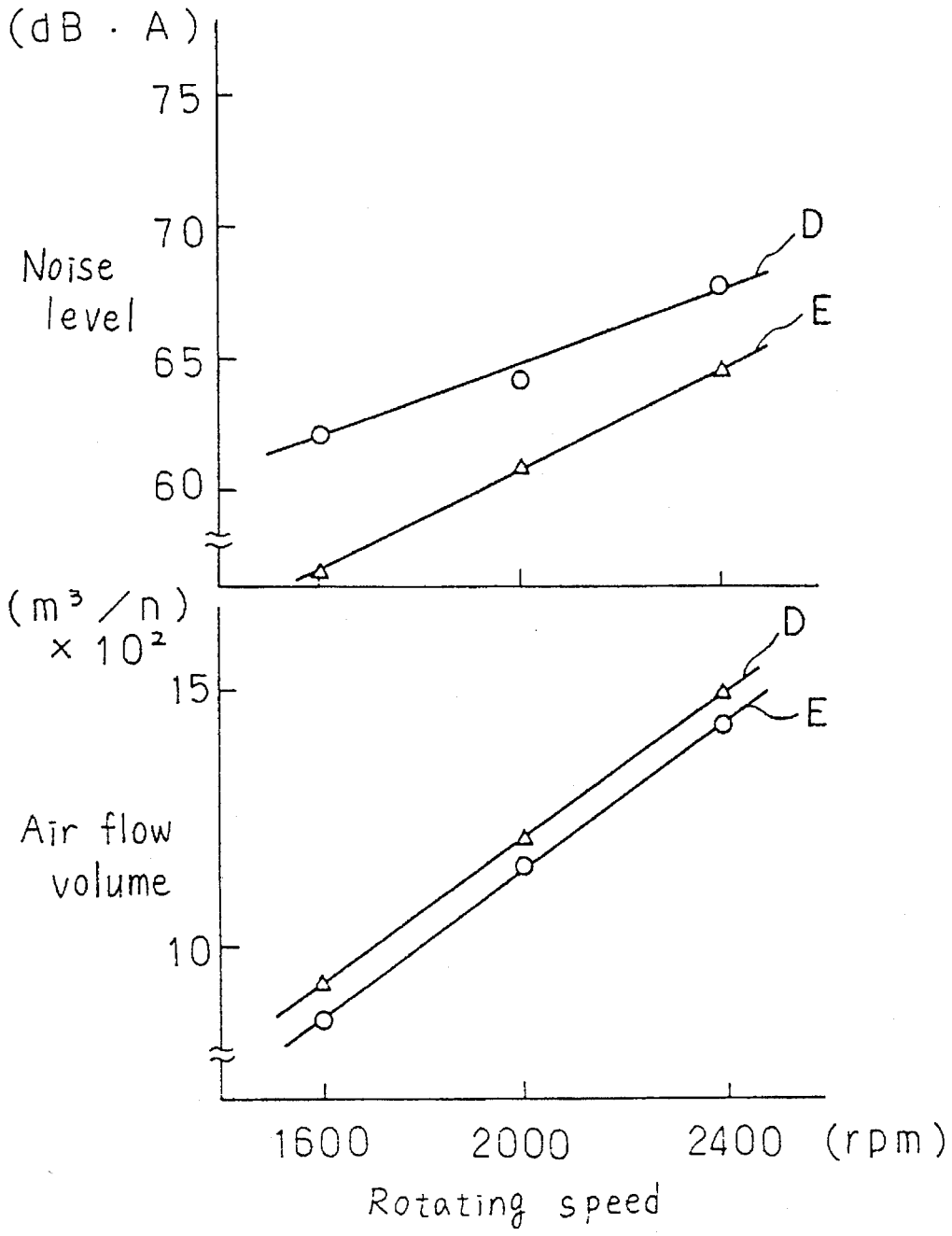
FIG. 25 shows the relationship between the rotating speed and noise level and air flow volume.
Figure 26:
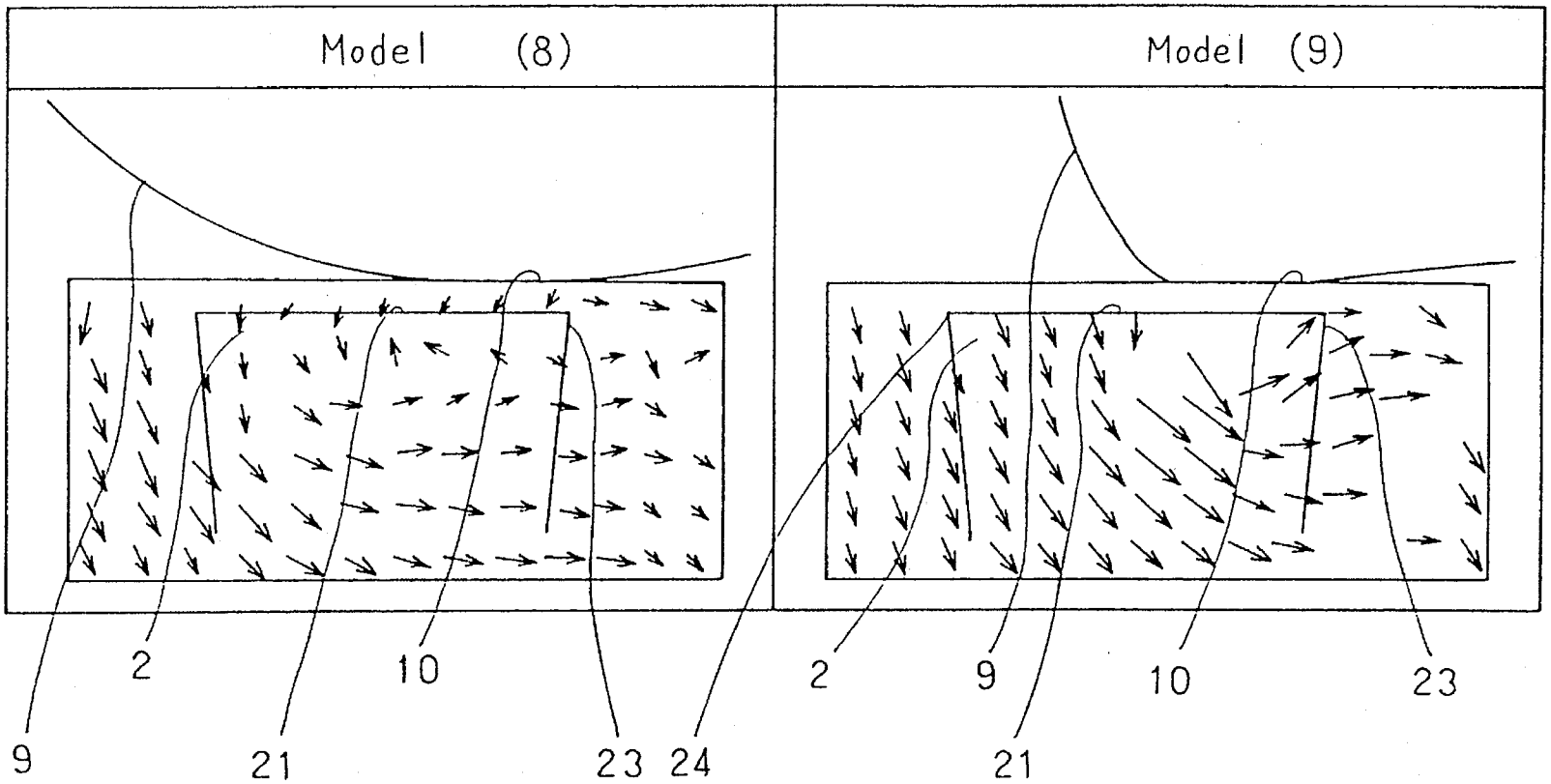
FIG. 26 shows the velocity of the air flow.
Figure 27:
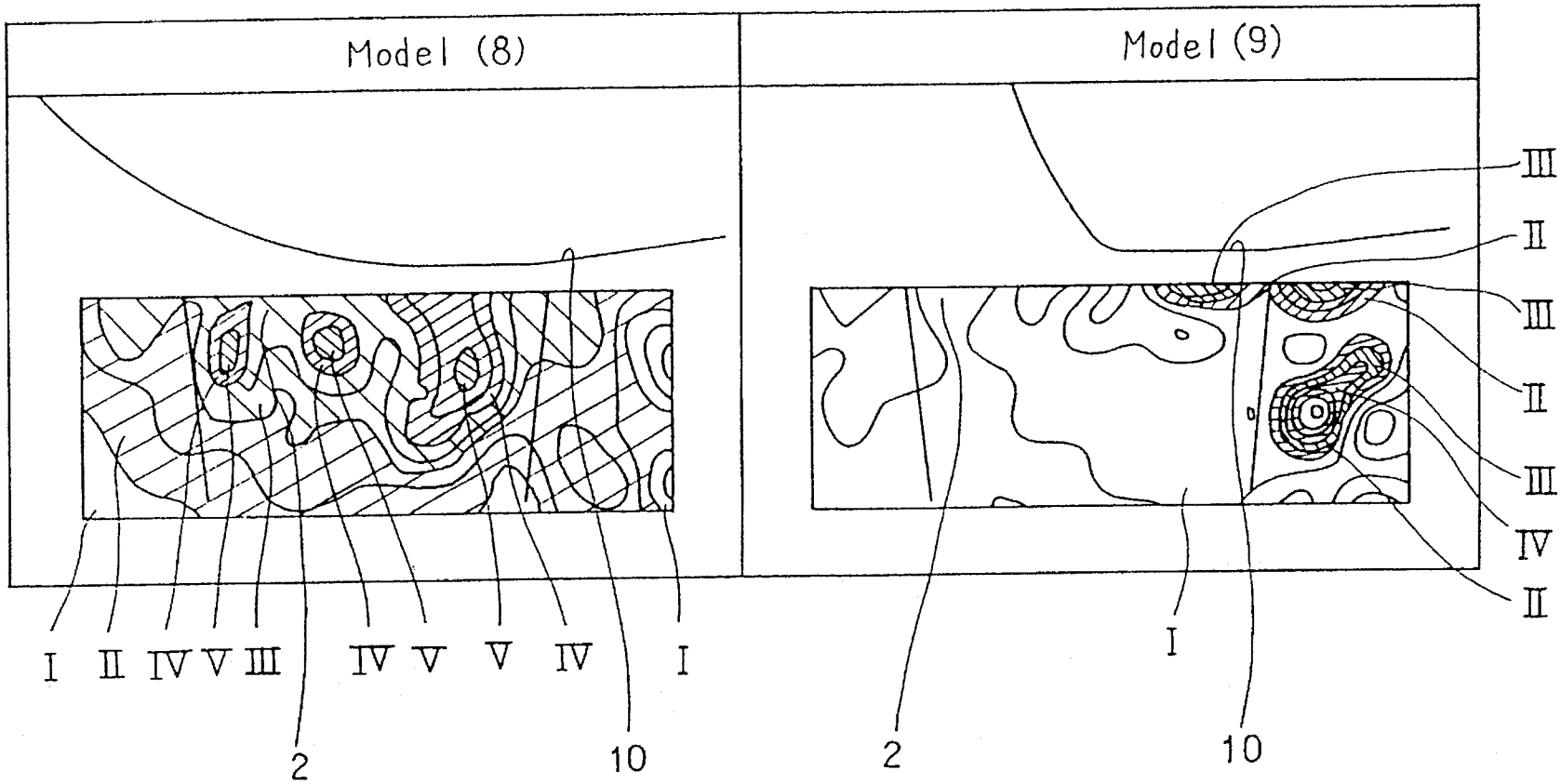
FIG. 27 shows the turbulent flow within the air flow.

The detailed relationship between the tip clearance T and the noise level when the relative length K is 0 is described in FIG. 13, and also detailed relationship between the radius curvature r and the noise level when the relative length K is 0 is described in FIG. 14. As shown from the test data of FIGS. 13 and 14, the fan apparatus having the radius curvature r between 4.5 mm and 7.5 mm and the tip clearance t between 2.0 mm and 4.0 mm can reduce the noise level more than 0.5 DB.

What is claimed is:

1. A fan apparatus positioned upstream of a cooling object for impelling air in a direction of the cooling object, comprising;

a fan blade positioned upstream of said cooling object for blowing air toward said cooling object, and a fan shroud positioned outside of said fan blade for stabilizing the air flow generated by said fan blade, said fan shroud having a cylindrical portion facing an outer periphery of said fan blade via predetermined tip clearance t and having an intake portion joined at an upstream side of said cylindrical portion and opening to an upstream direction, said cylindrical portion overlapping said fan blade on the downstream width of said fan blade by an amount greater than 0.3 and less than 0.6 of the width of said fan blade, and said intake portion flairing radially and in an upstream direction and having an axial length a which is smaller than a radial length b of said intake portion so that said intake portion expands quickly for introducing the air flow flowing inwardly toward said fan blade.

2. A fan apparatus claimed in claim 1, wherein;

said intake portion of said fan shroud is bellmouthed.

3. A fan apparatus claimed in claim 1, wherein;

said fan shroud prevents the reverse flow at the outer edge of said fan blade.

4. A fan apparatus claimed in claim 1, wherein;

the radial length b of said intake portion and a radial length R of said fan blade has the relationship of $\frac{1}{15} \times R \leqq b$.

5. A fan apparatus claimed in claim 1, wherein;

said intake portion of said fan shroud has a circular portion at said juncture between said intake portion and said cylindrical portion, a radius curvature r of said circular portion is $4.5\ \text{mm} \leqq r \leqq 7.5\ \text{mm}$.

6. A fan apparatus claimed in claim 1, wherein;

the tip clearance t between said fan shroud and said fan blade is $2\ \text{mm} \leqq t \leqq 4\ \text{mm}$.

* * * * *